US010202823B2

(12) United States Patent
Hall et al.

(10) Patent No.: US 10,202,823 B2
(45) **Date of Patent: *Feb. 12, 2019**

(54) WELL TREE HUB AND INTERFACE FOR RETRIEVABLE PROCESSING MODULES

(71) Applicant: OneSubsea IP UK Limited, London (GB)

(72) Inventors: Graham Hall, Aberdeen (GB); Graham Shee, Aberdeen (GB); Craig McDonald, Aberdeen (GB)

(73) Assignee: OneSubsea IP UK Limited (GB)

( * ) Notice: Subject to any disclaimer, the term of this patent is extended or adjusted under 35 U.S.C. 154(b) by 9 days.

This patent is subject to a terminal disclaimer.

(21) Appl. No.: 15/645,656

(22) Filed: Jul. 10, 2017

(65) Prior Publication Data

US 2017/0306720 A1 Oct. 26, 2017

Related U.S. Application Data

(63) Continuation of application No. 14/380,254, filed as application No. PCT/US2013/027165 on Feb. 21, 2013, now Pat. No. 97,202,220.

(60) Provisional application No. 61/601,478, filed on Feb. 21, 2012.

(51) Int. Cl.

| | |
|---|---|
| ***E21B 33/03*** | (2006.01) |
| ***E21B 33/035*** | (2006.01) |
| ***E21B 34/02*** | (2006.01) |
| ***E21B 34/04*** | (2006.01) |
| ***E21B 33/038*** | (2006.01) |

(52) U.S. Cl.
CPC ..... *E21B 34/02* (2013.01); *E21B 33/03* (2013.01); *E21B 33/035* (2013.01); *E21B 33/038* (2013.01); *E21B 34/04* (2013.01)

(58) Field of Classification Search
CPC ..... E21B 33/03; E21B 33/035; E21B 33/038; E21B 34/02; E21B 34/04
See application file for complete search history.

(56) References Cited

U.S. PATENT DOCUMENTS 4,171,922 A * 10/1979 Coulboy ..... E21B 33/038 166/341
5,163,782 A * 11/1992 Paulo ..... F16L 37/002 166/360

(Continued)

FOREIGN PATENT DOCUMENTS

WO WO-0047864 A1 * 8/2000 ..... E21B 33/035

*Primary Examiner* — Matthew R Buck
(74) *Attorney, Agent, or Firm* — Conley Rose, P.C.

(57) ABSTRACT

The present disclosure relates to providing a hub coupled into a production tree, manifold, or other equipment, and a base module that is attachable to and retrievable from the hub. The base module may be reconfigurable. The base module may be configured to receive other modules that are reconfigurable, wherein the other modules are retrievable from the base module. The hub provides a dedicated space or support at or near the production tree or equipment for using the base module. An interface is provided between the base module and the production tree. A fluid conduit provides a fluid path across or through the interface. The hub may be part of the interface such that the module can fluidly couple to the fluid conduit and the production tree across the interface via the hub.

19 Claims, 46 Drawing Sheets

(56) References Cited

U.S. PATENT DOCUMENTS

| | | | | |
|---|---|---|---|---|
| 6,481,504 | B1 * | 11/2002 | Gatherar | E21B 43/013 166/344 |
| 7,331,396 | B2 * | 2/2008 | Reimert | E21B 33/035 166/319 |
| 8,151,890 | B2 * | 4/2012 | Spencer | E21B 33/035 166/250.01 |
| 8,550,170 | B2 * | 10/2013 | McHugh | E21B 33/037 166/264 |
| 8,931,561 | B2 * | 1/2015 | Baker | E21B 41/10 166/341 |
| 9,702,220 | B2 * | 7/2017 | Hall | E21B 34/02 |
| 2010/0200241 | A1 * | 8/2010 | Ward | E21B 41/0014 166/341 |
| 2013/0000918 | A1 * | 1/2013 | Voss | E21B 34/04 161/344 |

* cited by examiner

WELL TREE HUB AND INTERFACE FOR RETRIEVABLE PROCESSING MODULES

CROSS-REFERENCE TO RELATED APPLICATIONS

The present application is a continuation of U.S. non-provisional application Ser. No. 14/380,254 filed on Aug. 21, 2014, entitled "Well Tree Hub and Interface for Retrievable Processing Modules," which is a 35 U.S.C. § 371 national stage application of PCT/US2013/027165 filed Feb. 21, 2013, entitled "Well Tree Hub and Interface for Retrievable Processing Modules," which claims the benefit of U.S. Provisional Application Ser. No. 61/601,478, filed Feb. 21, 2012, entitled "Wellhead Tree Hub and Retrievable Modules Therefor".

BACKGROUND

The present disclosure relates to apparatus and methods for coupling fluid processing or other apparatus into a production flow at or near a production tree, manifold or other equipment. The present disclosure also relates to apparatus and methods for diverting fluids, recovery, and injection.

Christmas trees or valve trees are well known in the art of oil and gas wells, and generally comprise an assembly of pipes, valves and fittings installed in a wellhead after completion of drilling and installation of the production tubing to control the flow of oil and gas from the well. Subsea christmas trees typically have at least two bores one of which communicates with the production tubing (the production bore), and the other of which communicates with the annulus (the annulus bore).

Typical designs of christmas trees have a side outlet (a production wing branch) to the production bore closed by a production wing valve for removal of production fluids from the production bore. The annulus bore also typically has an annulus wing branch with a respective annulus wing valve. The top of the production bore and the top of the annulus bore are usually capped by a christmas tree cap which typically seals off the various bores in the christmas tree, and provides hydraulic channels for operation of the various valves in the christmas tree by means of intervention equipment, or remotely from an offshore installation.

As technology has progressed for subsea installations, subsea processing of fluids is now desirable. Such processing can involve adding chemicals, separating water and sand from the hydrocarbons, pumping the produced fluids, analysing the produced fluids, etc.

SUMMARY

The present disclosure relates to providing a hub coupled into a production tree, manifold, or other equipment, and a base module that is attachable to and retrievable from the hub. The base module may be reconfigurable. The base module may be configured to receive other modules that are reconfigurable, wherein the other modules are retrievable from the base module. The hub provides a dedicated space or support at or near the production tree or equipment for using the base module. An interface is provided between the base module and the production tree. A fluid conduit provides a fluid path across or through the interface. The hub may be part of the interface such that the module can fluidly couple to the fluid conduit and the production tree across the interface via the hub.

BRIEF DESCRIPTION OF THE DRAWINGS

Embodiments of the disclosure will now be described by way of example only and with reference to the accompanying drawings in which.

DETAILED DESCRIPTION

Figure 1:
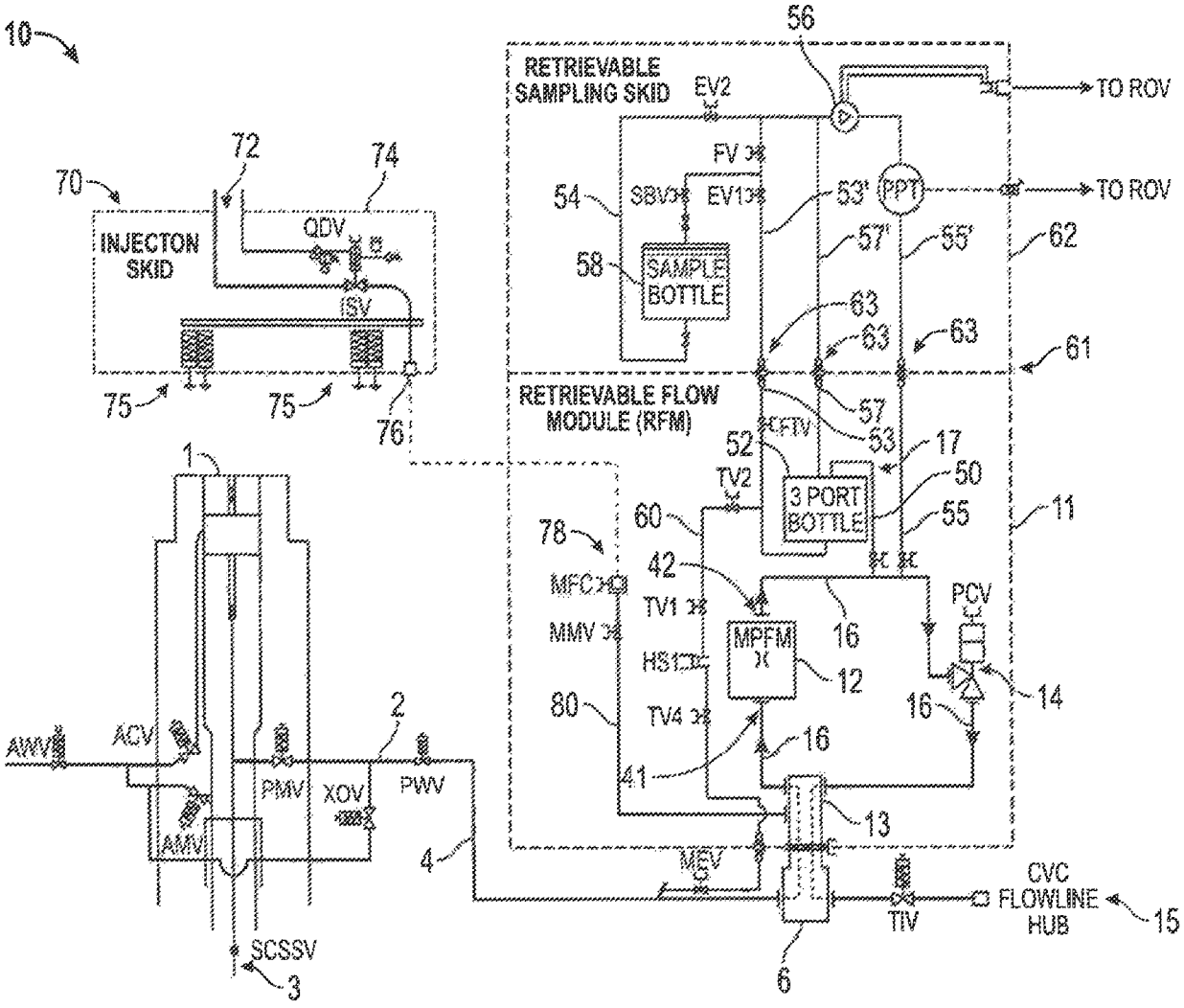
FIG. 1 is a schematic of an embodiment of a wellhead tree hub and retrievable module system.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The term "fluid" may refer to a liquid or gas and is not solely related to any particular type of fluid such as hydrocarbons. The terms "pipe", "conduit", "line" or the like refers to any fluid transmission means. The various characteristics mentioned above, as well as other features and characteristics described in more detail below, will be readily apparent to those skilled in the art upon reading the following detailed description of the embodiments, and by referring to the accompanying drawings The drawings and discussion herein are directed to various embodiments of the disclosure. Although one or more of these embodiments may be preferred, the embodiments disclosed are not intended, and should not be interpreted, or otherwise used, to limit the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment. The drawing figures are not necessarily to scale. Certain features of the invention may be shown exaggerated in scale or in somewhat schematic form, and some details of conventional elements may not be shown in the interest of clarity and conciseness.

FIG. 1 shows a schematic representation of an embodiment of a wellhead tree hub and retrievable module system 10. The system generally includes a module receiver or hub portion 6 and a connectable and retrievable module portion 11, 62. The system also includes a tree valve 1 disposed atop a production flow bore 3. Produced hydrocarbons flow up through the flow bore 3 and into tree 1. A wing valve block or master valve block 2 is coupled into the tree 1 such that it may divert flow from tree 1 and out through a conduit 4. Conduit 4 carries the diverted production flow from wing valve block 2 to the hub 6. The production flow is then directed through hub 6 and into a module 11 releasably coupled to the hub 6. In the embodiment shown, the module 11 includes a primary flow path 16 including a flow meter 12 and a choke or restrictor 14. In some embodiments, a sampling circuit portion 17 is also coupled into the primary flow path 16. As will be discussed in more detail below, the module 11 is a retrievable base module that may include components and configurations other than what is shown in FIG. 1. The module 11 may also be referred to as a flow module or processing module. The primary flow path 16 directs the production flow back to the hub 6. Thereafter, the flow exits hub 6 and is routed into a production flow line 15. As additional components and configurations are described in more detail below, reference will again be made to FIG. 1 for added clarity.

Figure 2:
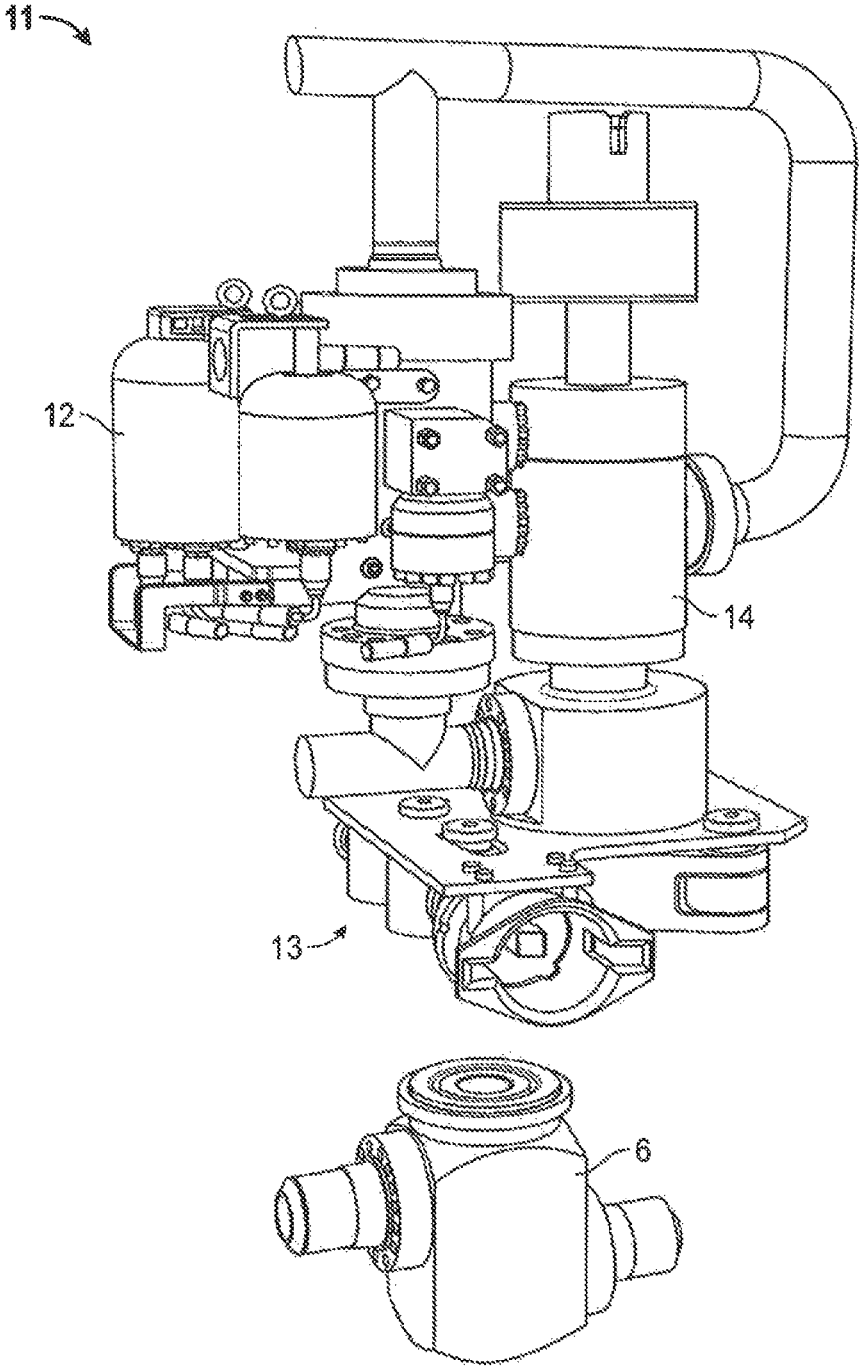
FIG. 2 is a perspective view of an embodiment of a retrievable processing module and a concentric or shared bore tree hub.
Figure 3:
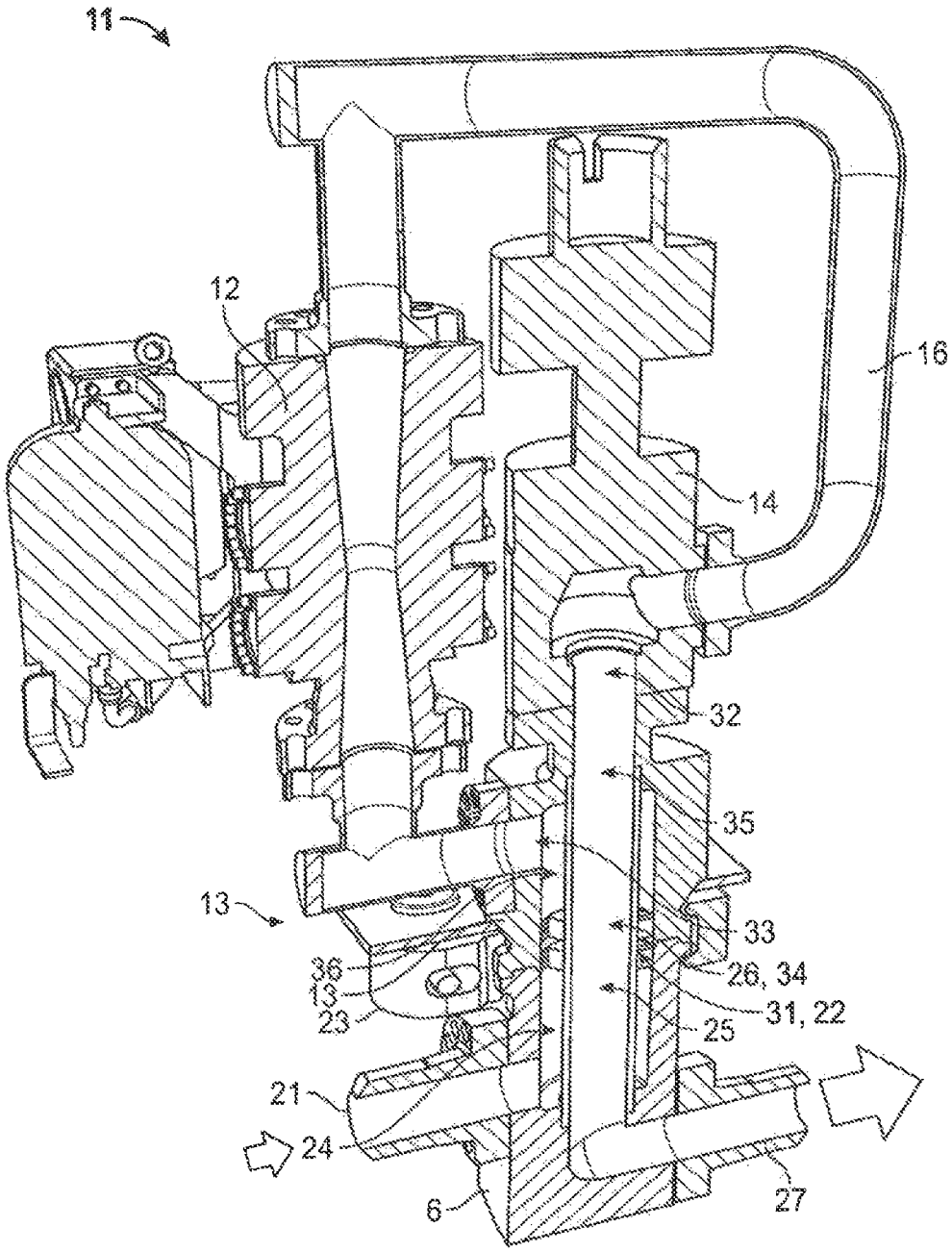
FIG. 3 is a cross-section view of the retrievable processing module and the tree hub of FIG. 2 coupled to illustrate internal flow paths.
Figure 4:
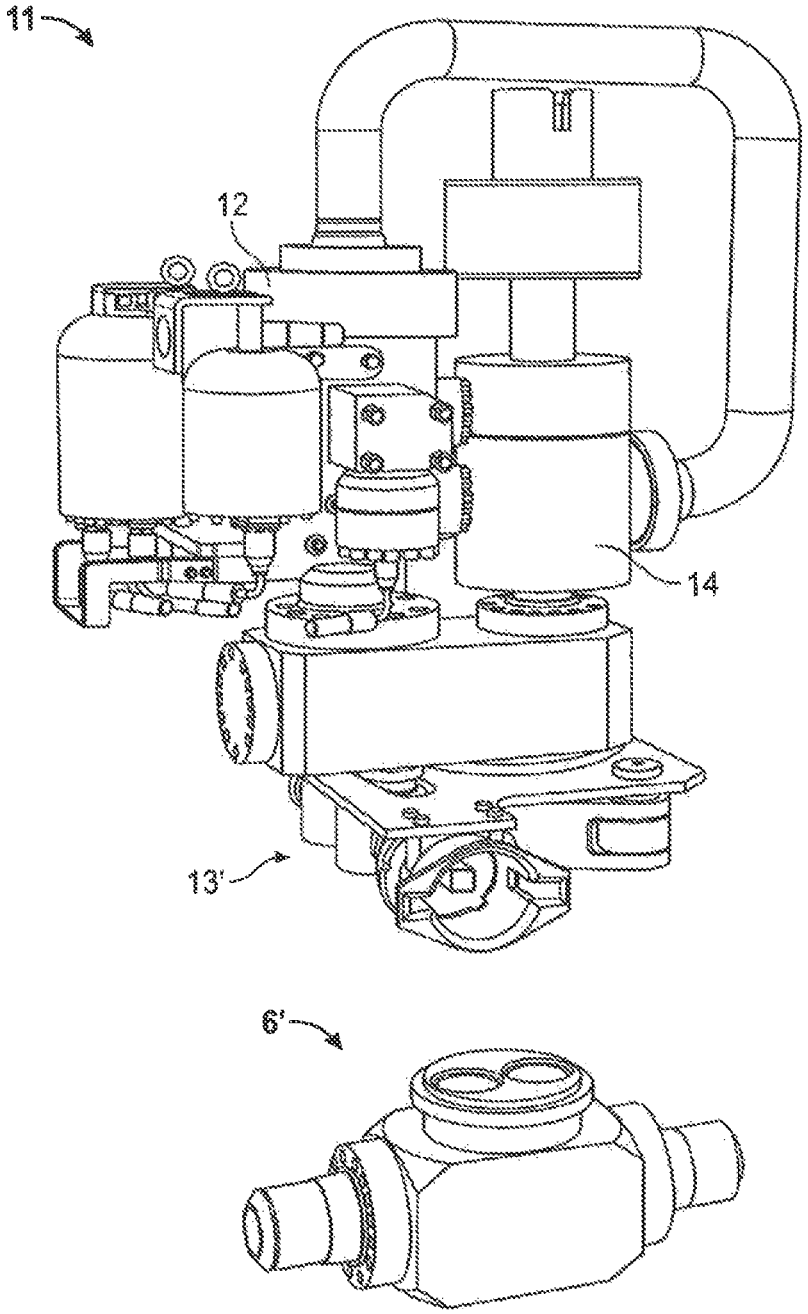
FIG. 4 is a perspective view of an alternative embodiment of a retrievable processing module and a dual or separate bore tree hub.
Figure 5:
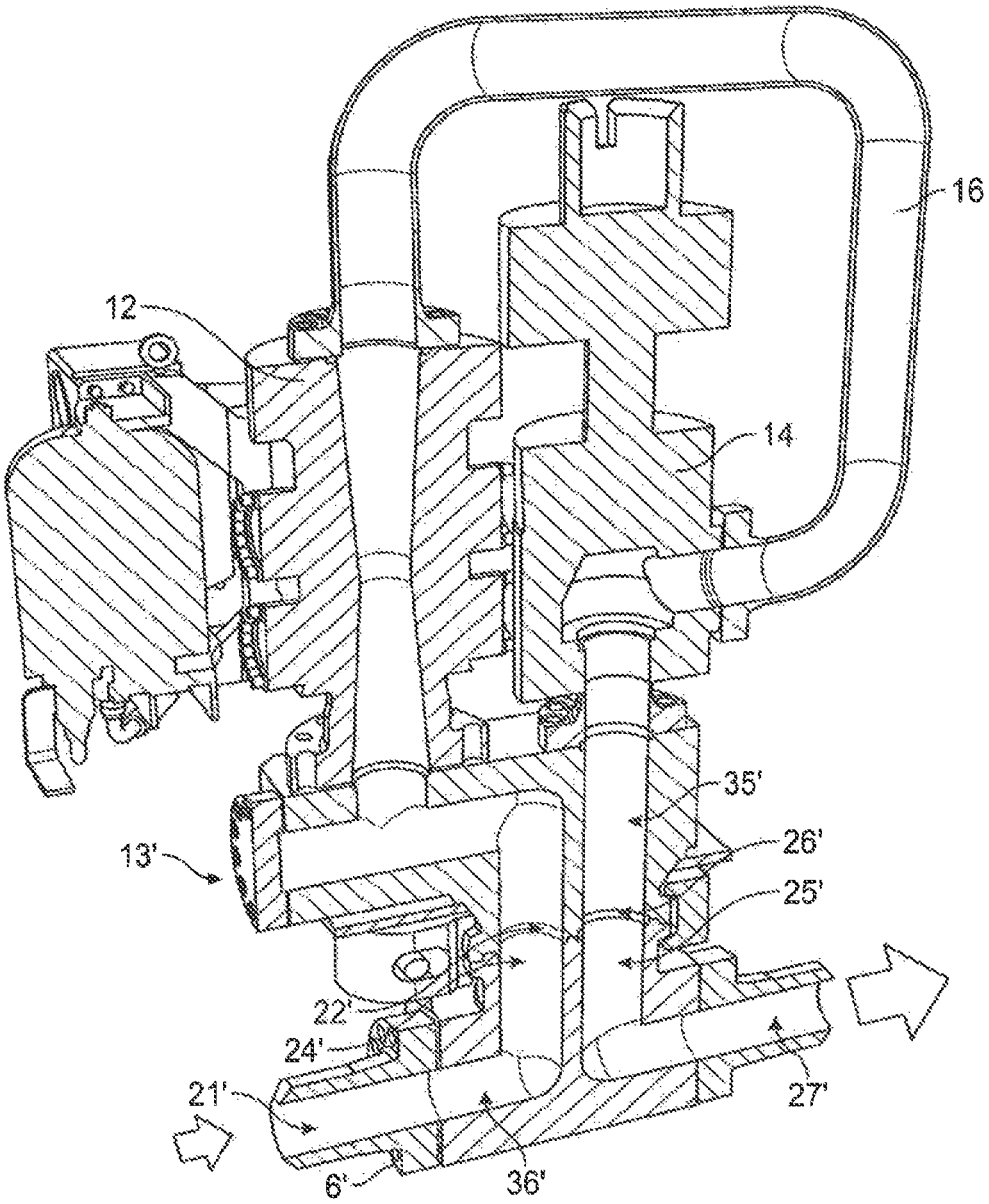
FIG. 5 is a cross-section view of the retrievable processing module and the tree hub of FIG. 4 coupled to illustrate internal flow paths.

Referring to FIGS. 2 and 3, the retrievable processing module 11 is connectable into the hub 6. In some embodiments, the hub 6 is a concentric bore connection including two inlets 21, 26, two outlets 22, 27, and two independent and concentric, shared, or annular flow paths 24, 25. Hub 6 may be designed such that flow paths 24, 25 are arranged one inside the other, or concentrically, within the hub body. As is best shown in FIG. 5, an alternative embodiment of the hub 6 may include a dual bore arrangement such that independent flow paths 24', 25' are each disposed within separate bores, as will be described more fully below.

Referring back to FIG. 3, during operation, production flow enters hub 6 through inlet 21, flows through independent flow path 24 and exits through outlet 22. Upon exiting hub 6, the production flow is then routed through the module 11 which will be discussed in more detail below. Upon exiting the module 11, the production flow re-enters hub 6 through inlet 26, flows through independent flow path 25, and exits through outlet 27.

Referring again to FIG. 1, some embodiments of the module 11 include a hub connector 13. Referring to again to FIG. 3, the hub connector 13 includes two inlets 31, 32, two outlets 33, 34, and two independent flow paths 35, 36. Hub connector 13 is secured to hub 6 via a clamp 23, such that inlet 31 corresponds to outlet 22 and outlet 34 corresponds to inlet 26 on hub 6. As is best shown in FIG. 5, an alternative embodiment hub connector 13' is designed to couple to and communicate with the dual bore hub 6' such that a connection at 22' creates at inlet flow path 21', 24' into the primary flow path 16 and a connection at 26' creates an outlet flow path 25', 27' from the primary flow path 16. Thus, the hub 6 includes concentric independent flow paths 35 and 36 and the hub 6' includes parallel independent flow paths 35' and 36'.

The flow meter 12 includes an inlet 41 and an outlet 42, as best shown in FIG. 1. In some embodiments, the flow meter 12 is a multiphase flow meter. In certain embodiments, the flow meter 12 includes various flow meters known to those with skill in the art and which may be used in hydrocarbon production flow lines and/or subsea. For example, the flow meter 12 may include flow meters manufactured by Roxar, Framo, or Multi Phase Meters (MPM).

Referring now to FIG. 1, in some embodiments, the base module 11 includes a lower sampling circuit portion or sampling saver sub 17. The sampling saver sub 17 includes an inlet line 50, a three port bottle 52, a flow through line 57, a sampling line 53, and an outlet line 55. The lines 53, 55, 57 also include fluid line connectors at 63. In a sampling configuration of the system 10, a releasable sampling module or retrievable sampling skid 62 can be coupled to the base module 11 (refer also to FIG. 7). The sampling module 62 also includes fluid line connectors at 63 to form fluid couplings 63. The sampling module 62 includes an inlet line 53' to be coupled to the inlet line 53, a flow through line 57' to be coupled to the flow through line 57, and an outlet line 55' to be coupled to the outlet line 55. The inlet line 53' includes a sampling bypass flowline 54 having a sample bottle 58. A pump 56 is disposed between the lines 57' and 55'. During operation, production fluid is diverted into inlet line 50 and flows to three port bottle 52, which acts as a diverter or separator for the incoming production fluid. The production fluid may be passed through lines 57, 57' or diverted to lines 53, 53'. If the fluid is diverted to line 53', then a sample of the fluid may be taken using the sample bypass line 54 and the sample bottle 58. The production fluid is then directed to outlet line 55' and through the pump 56 where it will be further directed to outlet line 55 and subsequently tied back in to primary flow line 16.

In some embodiments, the three port bottle 52 includes the embodiments disclosed in U.S. application Ser. No. 13/370,471 entitled "Apparatus and System for a Vortex Three Port Container" filed Feb. 10, 2012.

In some embodiments, a flush line 60 is coupled into line 53 and provides a flow of a flush fluid, such as methanol, from valve tree 1. The flow of methanol from valve tree 1 through flush line 60 is used to clean out the sampling systems 17, 62 to avoid cross contamination of multiple samples through the system.

Figure 6:
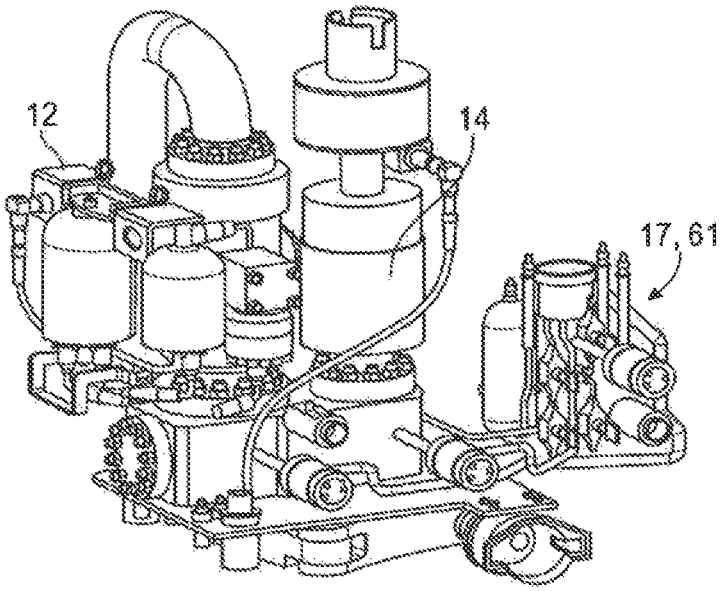
FIG. 6 is a perspective view of an embodiment of a retrievable processing module.
Figure 7:
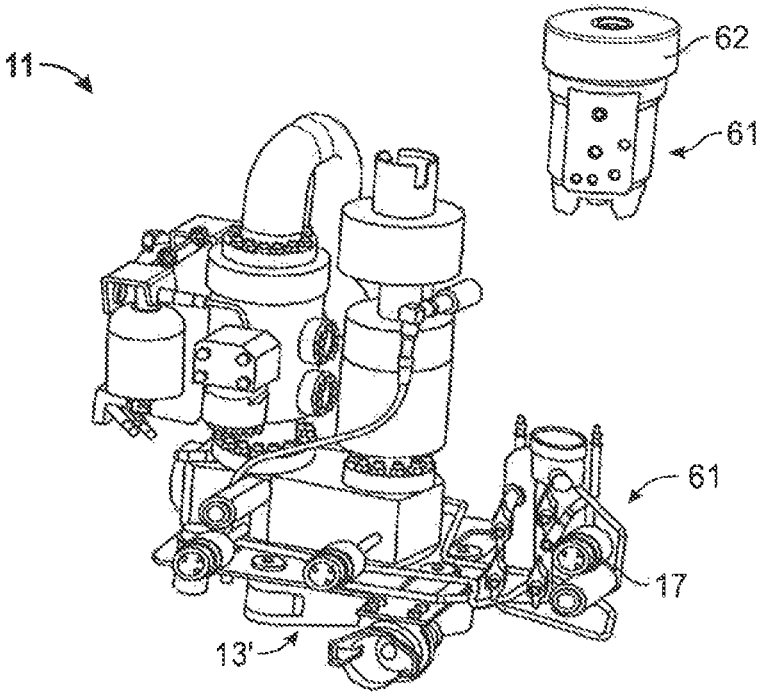
FIG. 7 is a perspective view of another embodiment of a retrievable processing module.

According to some embodiments, the sampling subsystem 61 includes two portions. A first portion 17 is attachable in the base module 11 in the form of a sampling module or saver sub, as shown in FIG. 6. A second portion 62 is also attachable and retrievable from the base module in the form of a sampling skid or supplemental module. Thus, the base module 11 can be configured with the sampling sub 17 and the retrievable sampling skid 62 can be coupled to the base module 11 via hydraulic connections 63 to complete a sampling circuit or subsystem 61. Consequently, the retrievable sampling skid 62 can be installed subsequent to installing the base module 11, and can be retrieved as shown in FIG. 7 to recover a captured sample or to obtain other information gathered by the sampling skid 62.

Referring still to FIG. 1, the choke 14 is located downstream of the flow meter 12. In the sampling configuration, the choke 14 is also downstream of the sampling subsystem 61. The specific design of choke 14 will be determined from the specific system parameters of the given well, and will vary from embodiment to embodiment.

Figure 9:
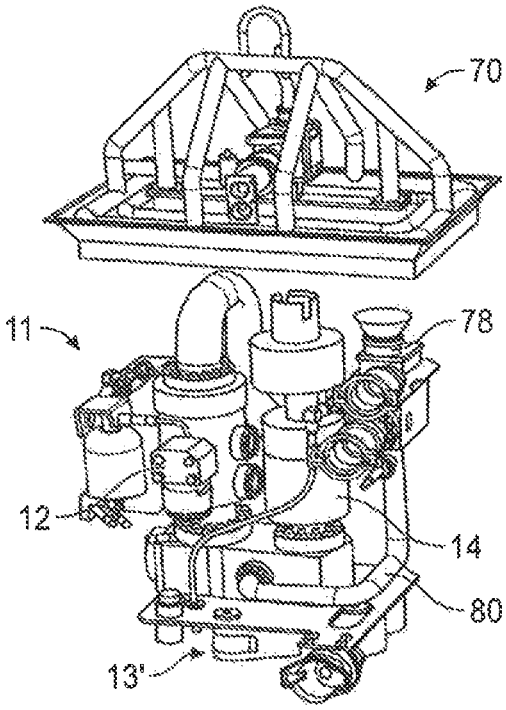
FIG. 9 is a perspective view of a further embodiment of a retrievable processing module.

Referring now to FIG. 1 and FIG. 9, some embodiments of the retrievable module system 10 include an injection skid 70 for inserting other fluids or chemicals into the production flow line 15 and even back into the production well 3. The injection skid 70 includes an injection line 72, a control system 74 with an injection swab valve ISV, landing pistons 75, and an injection hub connector 76. During installation, injection hub connector 76 is connected to an injection hub 78 which is positioned on a conduit 80 which couples into the hub connector 13. Once installed, injection skid 70 can be used to inject the desired fluid from the surface through injection line 72, through the coupling created by the injection hub connector 76 and the injection hub 78, and into the hub connector 13. The control system 74 is used to open or close the ISV, which is failsafe-closed in some embodiments. The rate of injection is controlled from the pumps at the surface. In some embodiments, the ISV includes a valve that can be quickly closed to provide a barrier to the well. As shown in FIG. 9, the sampling sub 17 may be replaced in the reconfigurable module 11 by the injection hub 78 and conduit 80. The injection skid or module 70 may be coupled onto and/or retrieved from the base module 11 as needed.

In some embodiments, and as shown in FIGS. 2-5, the base module may have a basic configuration including the flow meter 12 and the downstream choke 14. The use of the hub connections 6, 13 and 6', 13' allows the choke 14 to be positioned downstream of the flow meter 12, such that the flow restrictions or disturbances caused by the choke 14 do not interfere with flow measurements taken by the flow meter 12.

Figure 8:
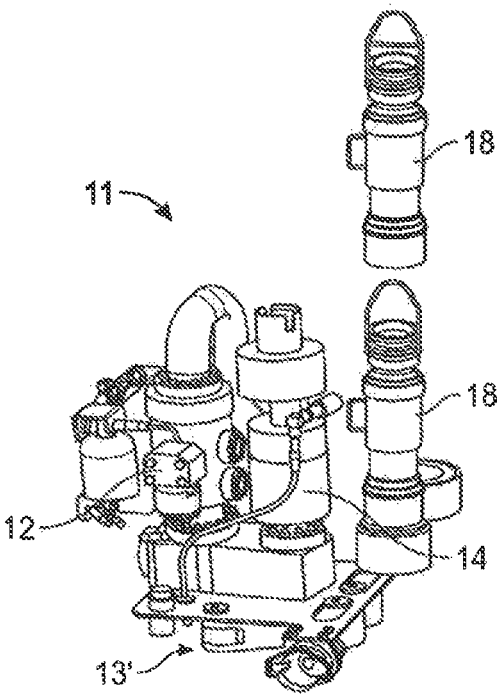
FIG. 8 is a perspective view of still another embodiment of a retrievable processing module.

Referring now to FIG. 8, some embodiments of the reconfigurable system 10 and reconfigurable base module 11 include the flow meter 12, the choke 14, pressure sensors (not shown), and a chemical metering device 18. In place of the chemical injection hub 78 or the sampling sub 17, the module 11 is equipped with the chemical metering device 18 which can be retrieved as shown in FIG. 8.

Referring to FIGS. 10-15, some embodiments include a running and installation sequence for the reconfigurable and retrievable system 10 and module 11. A support and receiver frame 101 is mounted adjacent the tree 1, such as to support the hub 6'. The valve block and conduit 2, 4 couples the hub 6' to the tree 1 in such a way that the hub 6' is set slightly apart from the tree in a dedicated space as shown in FIG. 5. The hub 6' may also be disposed at a relatively low position in regards to the main tree body. In some embodiments, the support frame 101 is coupled to or disposed adjacent the tree 1 structure such that it is supplemental to the tree 1 structure and can provide the dedicated space aside the tree 1 structure for the hub 6'.

The support frame 101 includes a substantially rectangular floor 103, support members 105, and a funnel 110 with inner tapered surfaces 112. Support frame 101 is disposed adjacent tree 1 and the hub 6' is disposed on floor 103 within support frame 101 to create a dedicated space for the hub 6'. A guidance skirt 120 includes a top 122, sides 124, an inner cavity 126, and is substantially rectangular in cross-section. The inner cavity 126 of skirt 120 is sized such that any one of the embodiments of the retrievable and reconfigurable base modules 11 herein disclosed may be received within the inner cavity 126. A running tool 125 is connected to the top 122 of skirt 120 and is further connected to support and running cables 127.

Figure 10:
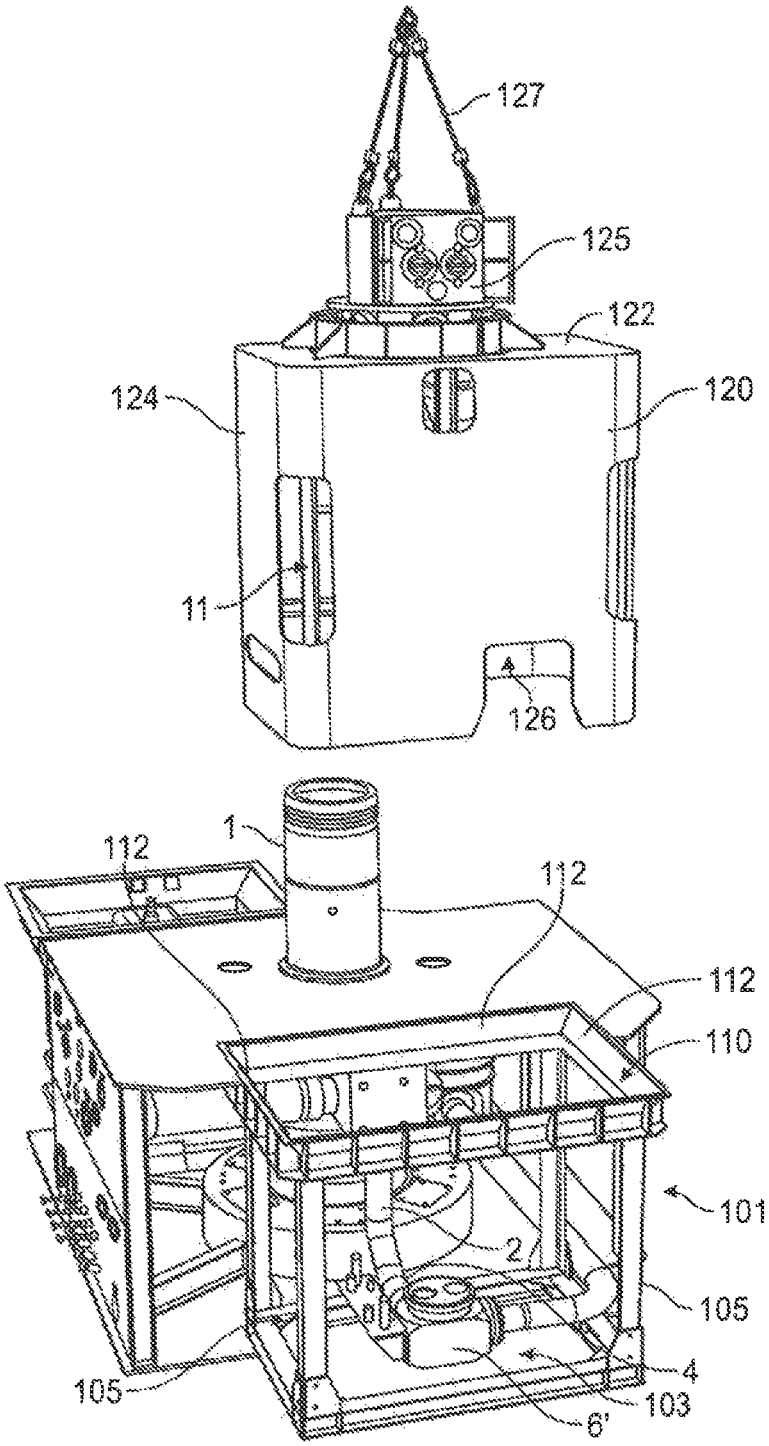
FIGS. 10-15 are perspective views of an embodiment of a procedure for installing a retrievable processing module next to a wellhead valve tree at in interface therebetween.
Figure 11:
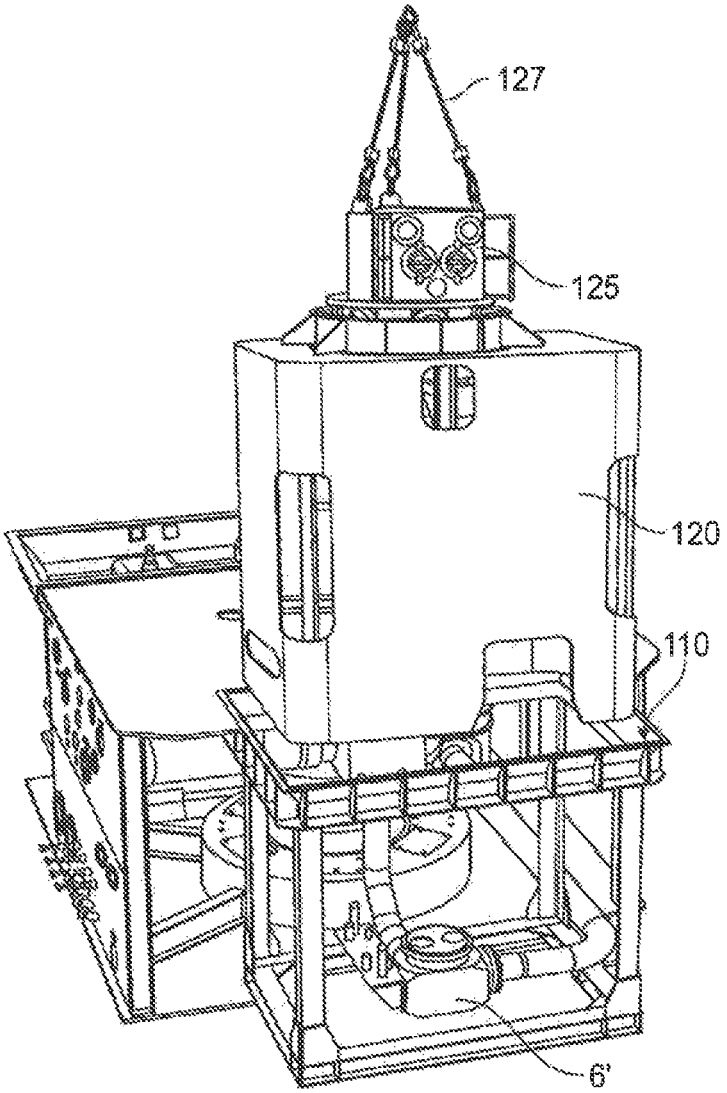
Figure 12:
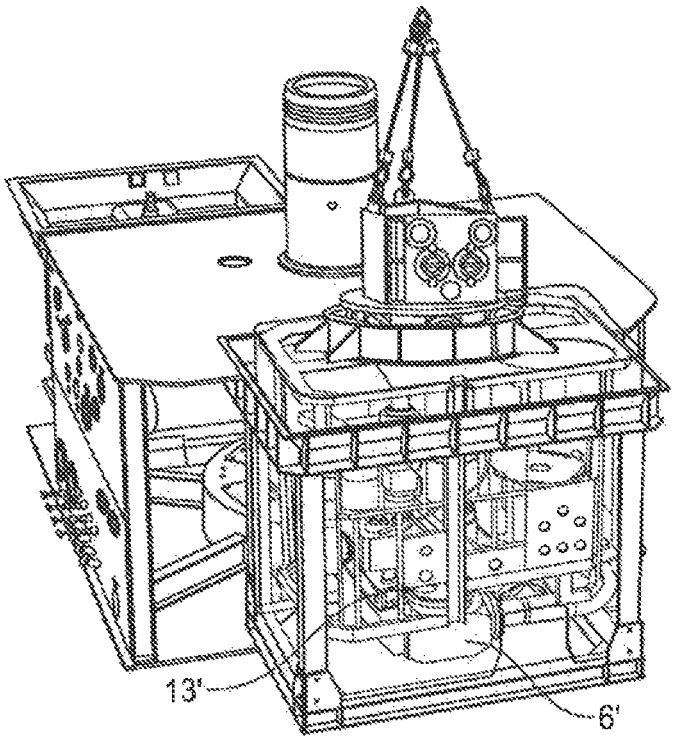
Figure 13:
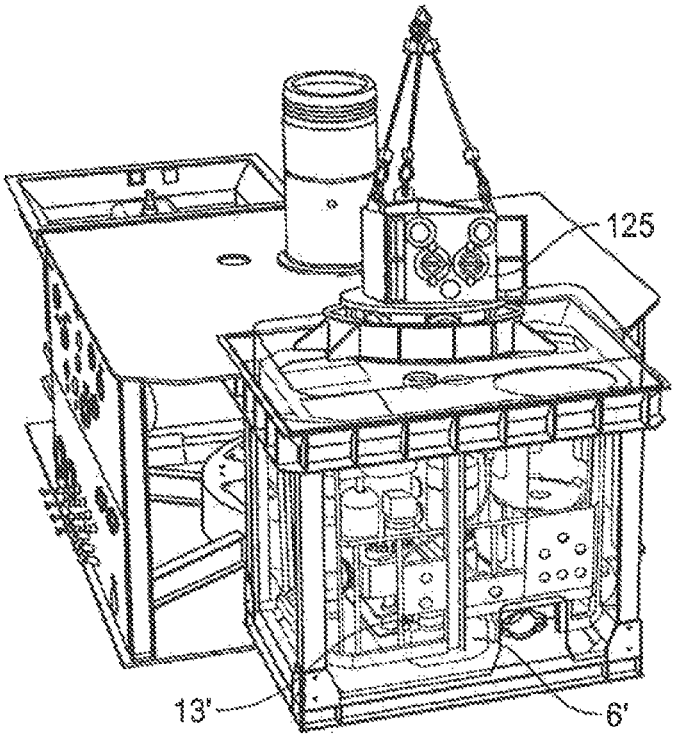
Figure 14:
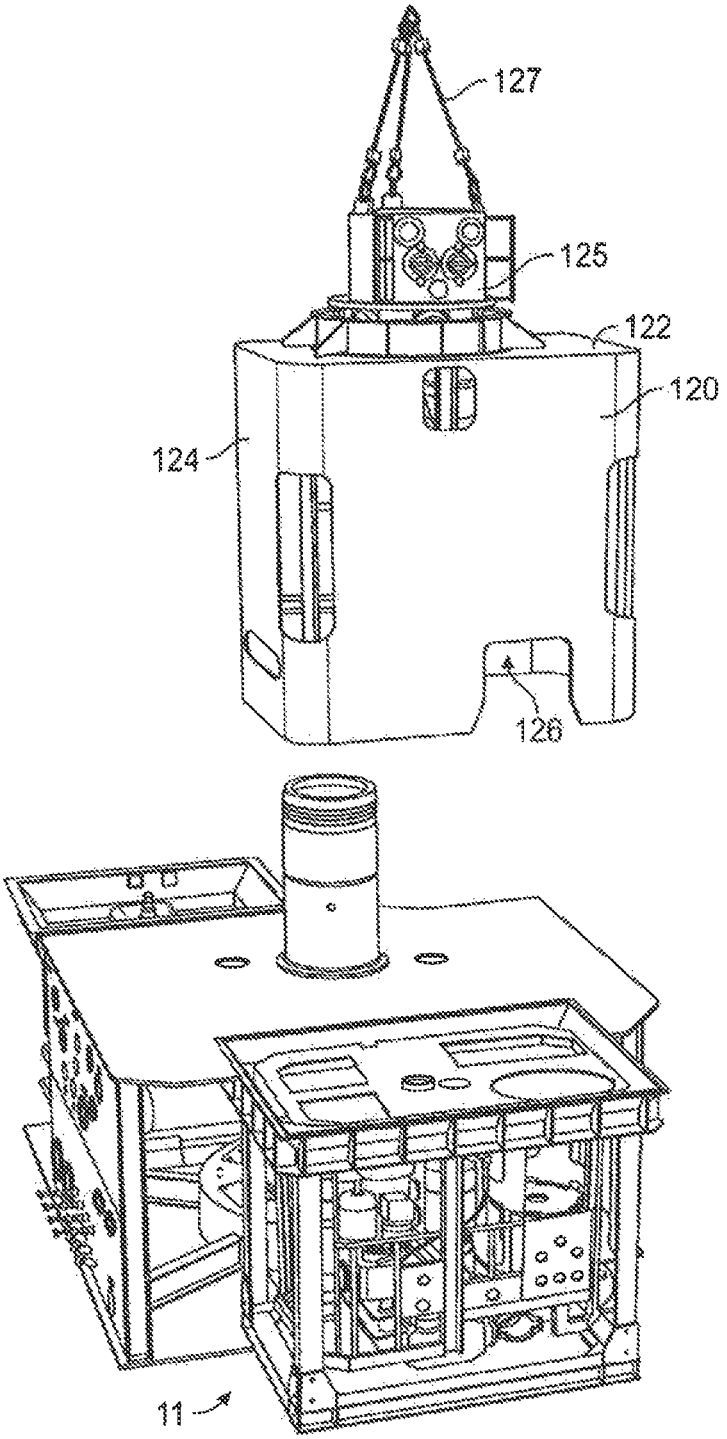
Figure 15:
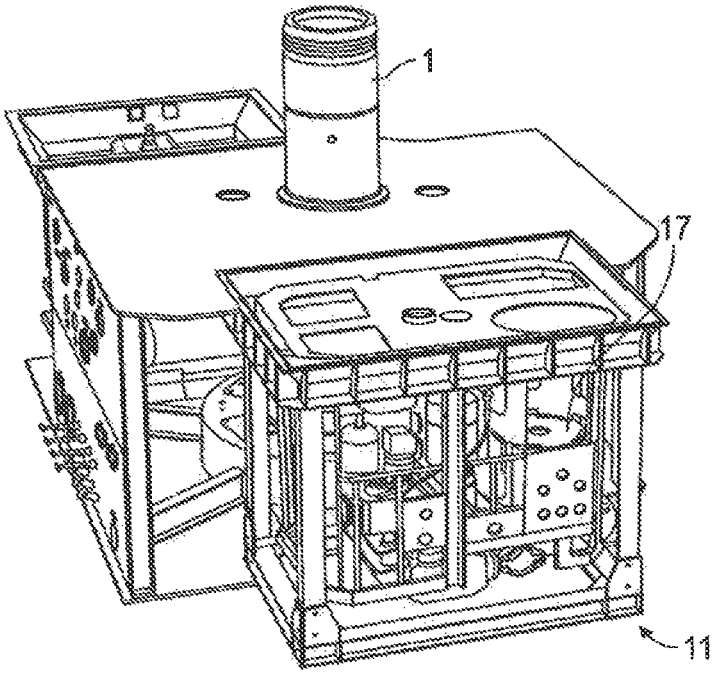
Figure 16:
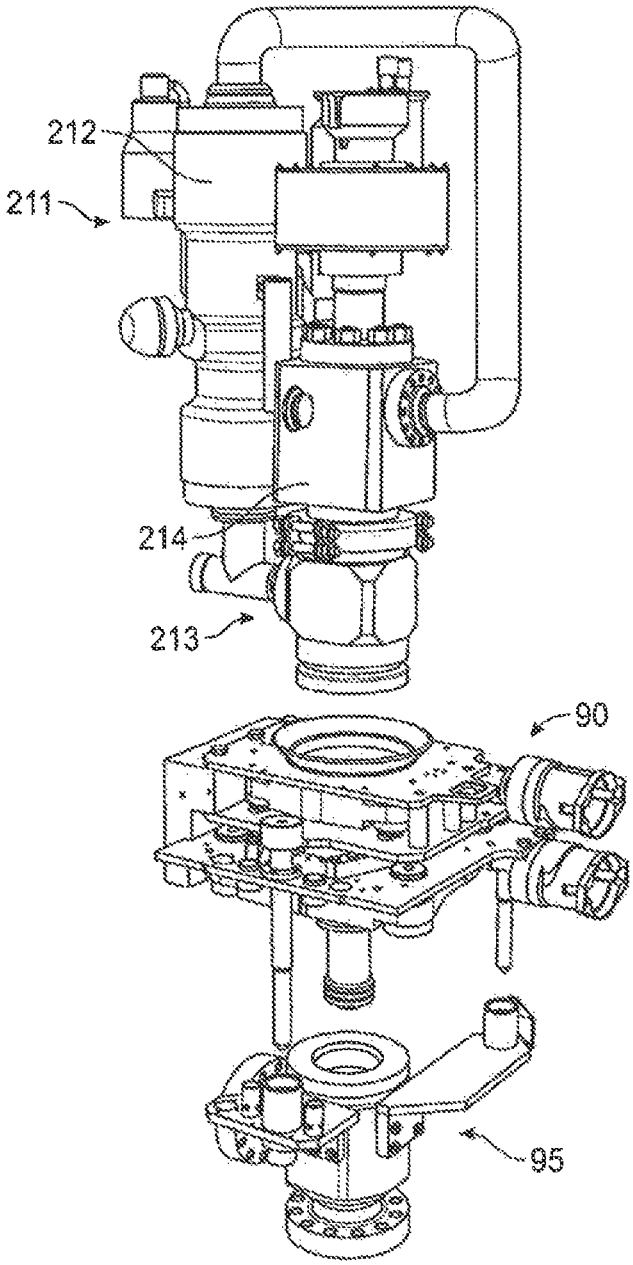
FIGS. 16-20 are perspective and cross-section views of various embodiments of processing modules coupled to existing chokes of a wellhead tree valve system.
Figure 17:
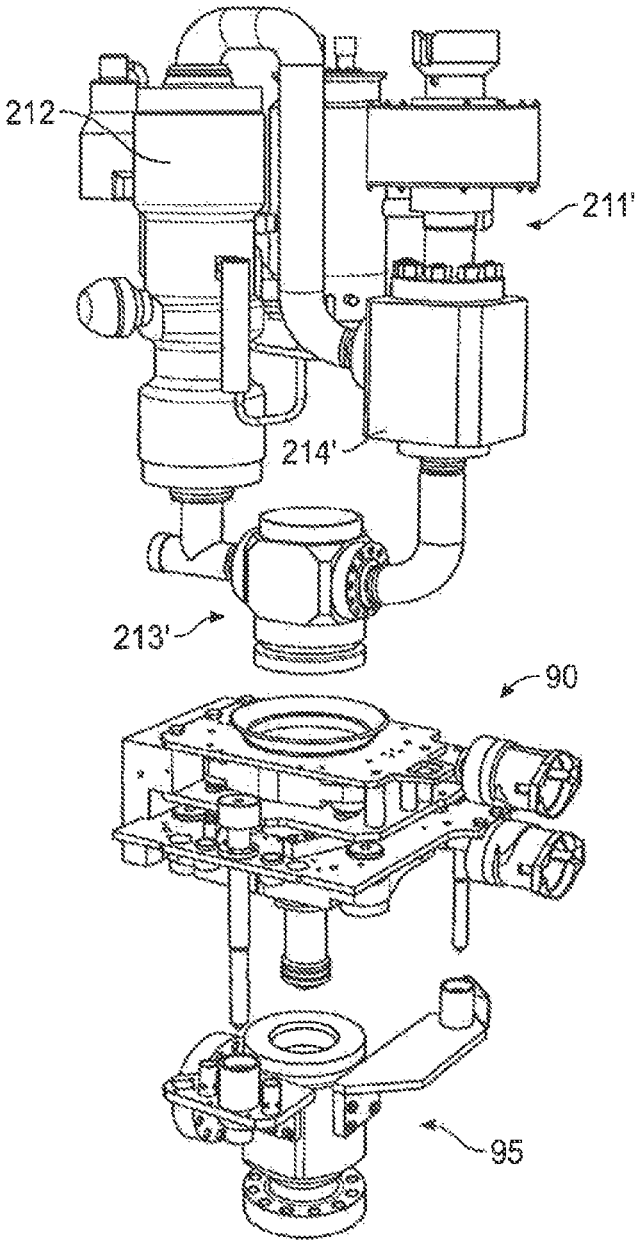

As is best shown in FIG. 10, the module 11 is lowered via guidance skirt 120, running tool 125 and cables 127. Funnel 110 on top of support frame 101 includes tapered inner surfaces 112 for receiving the bottom edges of sides 124 of skirt 120 as it is lowered into place via running tool 125 and cables 127, as shown in FIG. 11. Once guidance skirt 120 is aligned with support frame 101, the skirt 126 is lowered until hub connector 13' is aligned with but still clear of the hub 6' (FIG. 12). Referring to FIG. 13, a ROV can open a valve on the running tool 125 to hydraulically stroke the module 11 into the final installed position wherein the hub connector 13' is coupled to the hub 6. After coupling of hub connector 13' and hub 6' has been achieved, guidance skirt is raised out of frame 101 via running tool 125 and cables 127 leaving retrievable module 11 within support frame 101, as shown in FIG. 14. Referring to FIG. 15, the base module 11 is installed on or next to the tree 1, and in the particular configuration shown, a sampling saver sub 17 is awaiting connection with a sampling skid 62 as previously described with respect to FIG. 7. According to the description above, the support frame 101 and the hub 6' combine to form an interface between the module 11 and the tree 1. In some embodiments, the support frame 101 is a receiver or support interface, and the hub 6' is a fluid coupling interface. As shown in FIGS. 1 and 10, the valve block and conduit 2, 4 couples between the hub 6' and the tree 1 such that a flow line or flow path is provided through or across the interface. In other words, the fluid conduit 4 traverses the interface between the dedicated space for the hub 6' and the space occupied by the tree 1.

Retrieval of the base module 11 is achieved by reversing the sequence or steps as outlined for installation in FIGS. 10-15. First, guidance skirt 120 is lowered into support frame 101 via running tool 125 and cables 127, and the module 11 is secured inside inner cavity 126. Next, hub connector 13' is disconnected or decoupled from hub 6'. Finally, guidance skirt 120, containing retrievable module 11, is lifted out of support frame 101 and away from the production well 3, via running tool 125 and cables 127.

Figure 18:
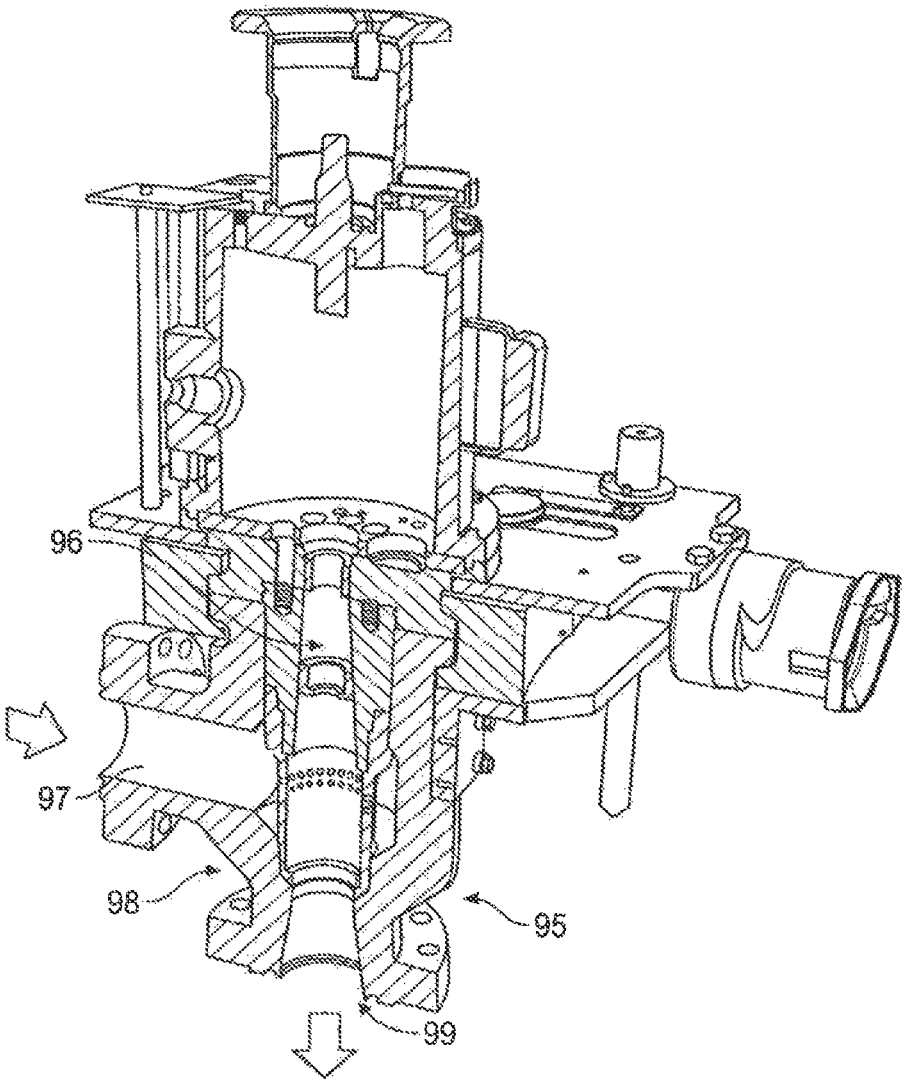
Figure 19:
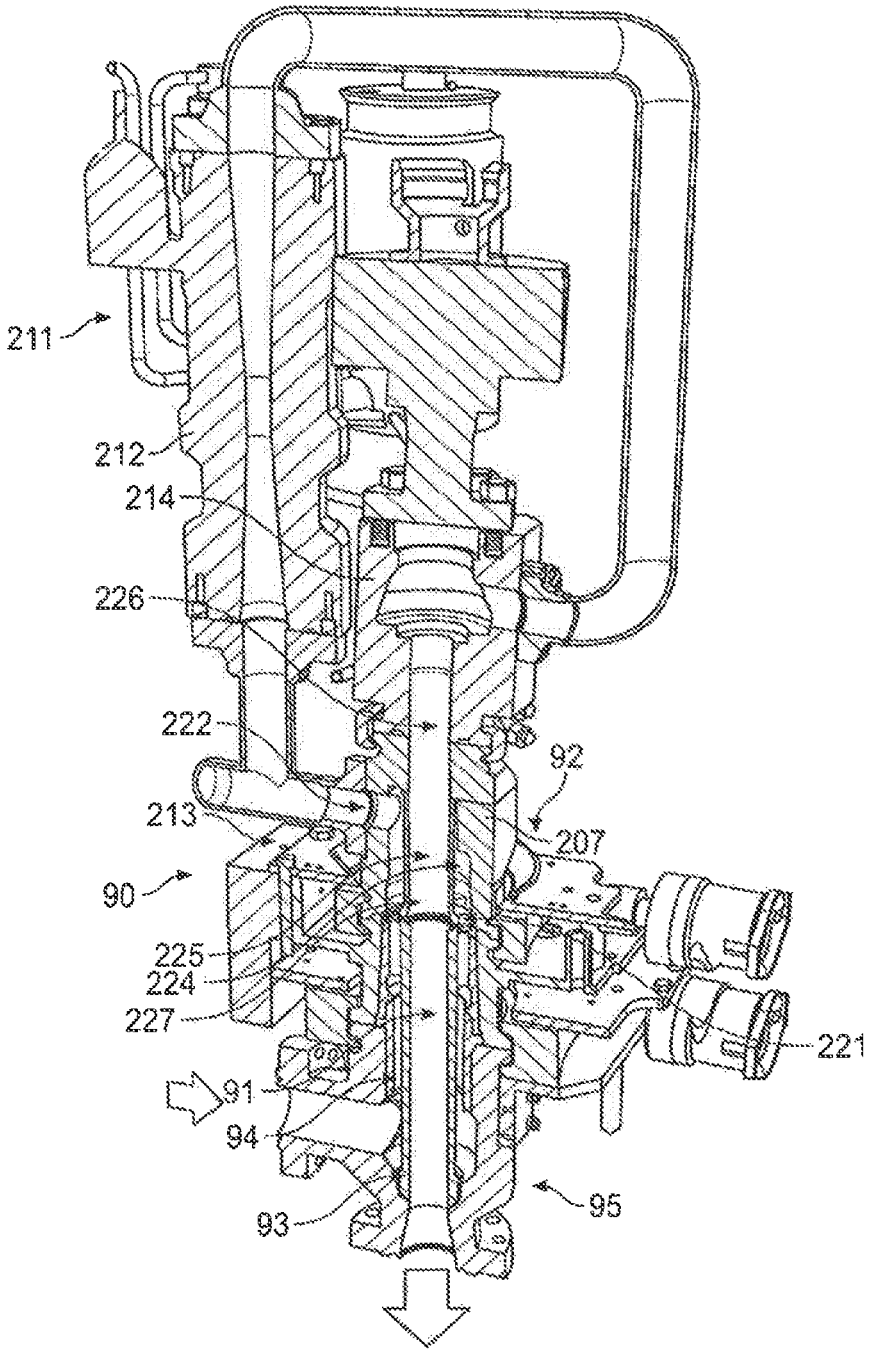

Referring to FIGS. 16-20, other embodiments of the base module can be incorporated into alternative tree connections. A base module 211, 211' includes a flow meter 212 and a downstream choke 214, 214' for eliminating interference with the flow measurements. The module 211, 211' includes a hub 213, 213' which is connectable to a choke insert or adapter 90, which is in turn connectable to an existing choke 95 which is disposed directly on a tree. As is best shown in FIG. 18, the choke 95 includes a body 98, a top opening 96 for receiving an insert, an inlet 97, and an outlet 99. Referring to FIG. 19, choke insert 90 includes a base 92, a central flow bore 91, an annular bore 94 and a sealing member 93. Hub 213 includes a body 207, two inlets 221, 226, two outlets 222, 227, an annular flow path 224 and a central flow path 225.

Figure 20:
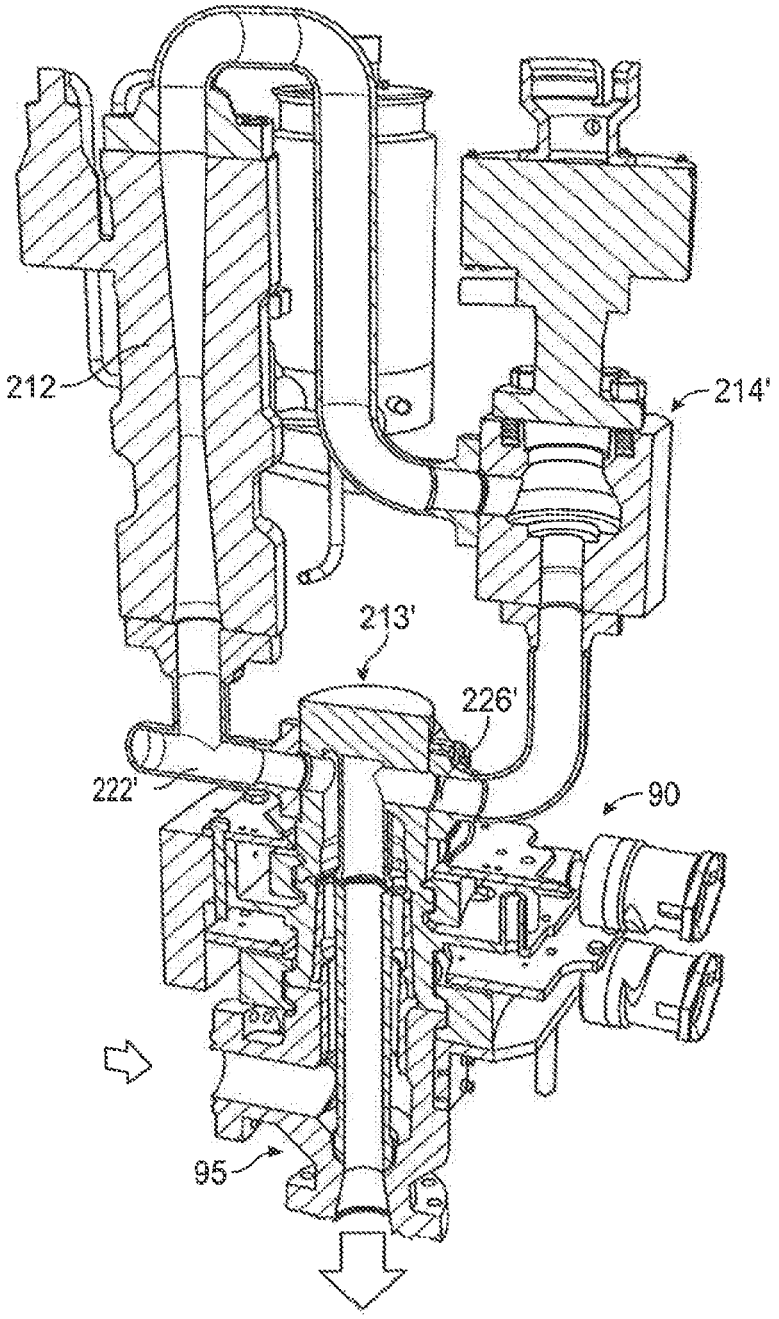

Referring still to FIG. 19, Hub 213 is coupled to base 92 of choke insert 95 such that central flow bore 91 is aligned with central flow path 225 and annular bore 94 is aligned with annular flow path 224. Sealing member 93 is then placed inside top opening 96 of choke 95. Sealing member 93 then makes contact with the inner walls of body 98 such that flow between inlet 97 and outlet 99 of choke 95 is obstructed, thus connecting central flow path 225 with outlet 99 and creating an annulus between the inner surface of body 98 and outer surface of sealing member 93 which connects with annular bore 94 and annular flow path 224. For the choke hub 213' as shown in FIG. 20, flow paths 222' and 226' couple into the sides of the hub 213' in an opposing relationship to communicate with the annular or concentric flow paths as just described.

Figure 21:
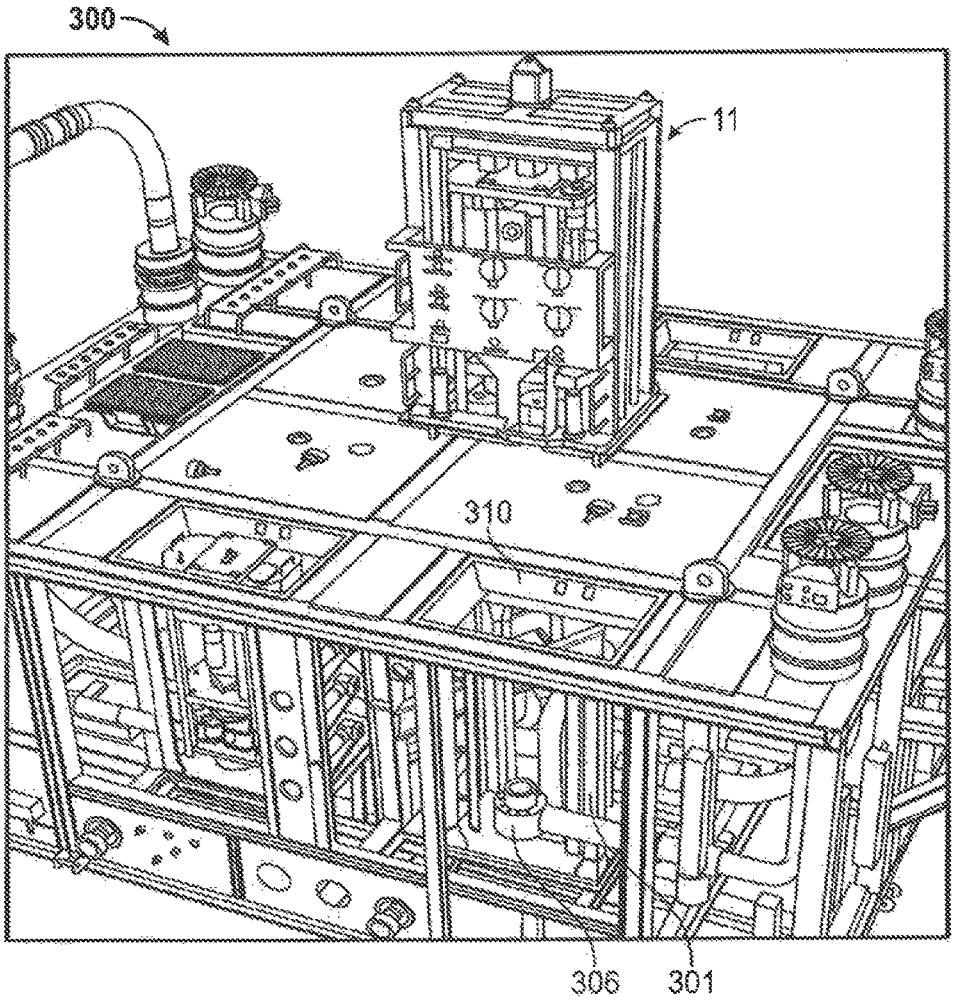
FIG. 21 is a perspective view of an embodiment of a processing module coupled to a subsea manifold.
Figure 22:
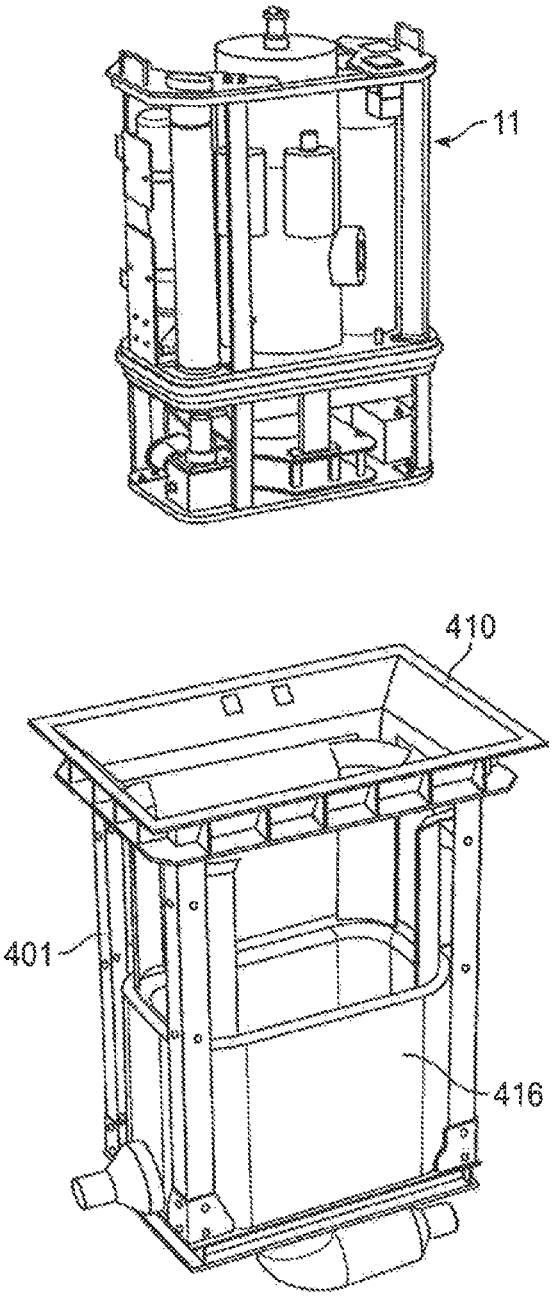
FIG. 22 is a perspective view of an alternative embodiment of FIG. 21 including a support frame mounted in a manifold wherein the support frame includes an insulated flowbase.

Referring to FIG. 21, still further embodiments of the base module 11 allow for connections to other subsea equipment, such as a manifold. The retrievable base module 11 can be lowered toward a manifold 300, as shown in FIG. 21. Manifold 300 essentially serves as a collection point for many separate wells and is tied into the main pipeline. Retrievable module 11 can be received in a support frame 301 with a funnel 310 mounted in the manifold 300. A hub 306 can receive the hub connection of the module 11 for full integration with the manifold 300, as previously described herein. The module 11 can be lowered toward manifold 300 via cables 127, running tool 125, and guidance skirt 120, and installed, as previously described. Referring now to FIG. 22, an alternative embodiment includes a support frame 401 with funnel 410 mounted in a manifold. The support frame 401 includes an insulated flowbase 416. The support frame 401 is able to receive and couple with various base modules 11 described herein and in a manner as described herein.

Using the principles and various embodiments of the disclosure described above, additional embodiments of a wellhead tree hub and retrievable module system may include further embodiments of modules configurable into the base module 11 and/or attachable onto the base module, such as in place of the sampling module 17, the sampling skid 62, the metering module 18, or the chemical injection skid 70. For example, a supplemental module SM may include one or more of the following devices or components, in various combinations or configurations as desired: a metering device, such as a multiphase meter, a wet gas meter, or a water cut meter; a choke valve, such as a fixed bonnet or an insert retrievable; instrumentation, such as pressure instrumentation and/or temperature instrumentation; an erosion device such as a gauge or a comparator; a corrosion device, such as a gauge or comparator; a sand detection device, such as an acoustic meter or a sand sample capture; a chemical injection (intervention) device, such as for scale squeeze, well stimulation, well kill, or well abandonment (cementing); a chemical injection device (production), such as for chemical injection metering or chemical injection tie-in; a reservoir fracturing device; a hydrate remediation device; a sampling device, such as for well produced fluid or tracer detection; a controls module (fixed or retrievable); a well abandonment module; and an annulus access configuration module. In some embodiments, larger packages may tie-in through the hub connection. Such packages can be sighted on top of the tree or on an adjacent foundation pile and use a compliant loop or jumper to connect to the dual bore hub on the tree. Examples of larger packages are: subsea processing modules, such as for pumping or boosting, separation, or solids knockout; a well test module; and HIPPS (High Integrity Pipeline Protection system).

Using the principles and various embodiments of the disclosure described above, additional embodiments of a wellhead connection and module system may include the embodiments or portions thereof as disclosed in one or more of U.S. Pat. No. 8,122,948 entitled "Apparatus and Method for Recovering Fluids from a Well and/or Injecting Fluids into a Well," U.S. application Ser. No. 13/267,039 entitled "Connection System for Subsea Flow Interface Equipment" filed Oct. 6, 2011, and Application Number GB1102252.2 entitled "Well Testing and Production Apparatus and Method" filed Feb. 9, 2011 and its corresponding PCT application.

Figure 23:
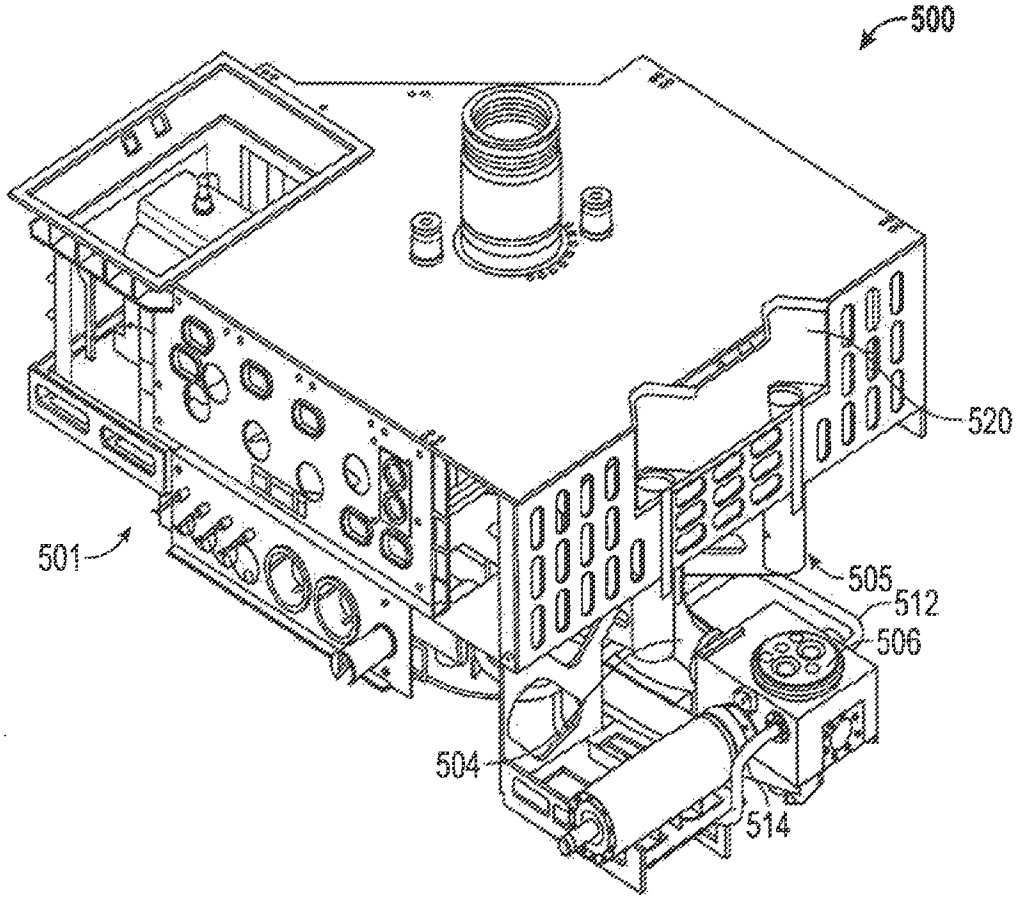
FIG. 23 is a perspective view of an embodiment a vertical wellhead valve tree structure and retrievable fluid processing module interface system.
Figure 24:
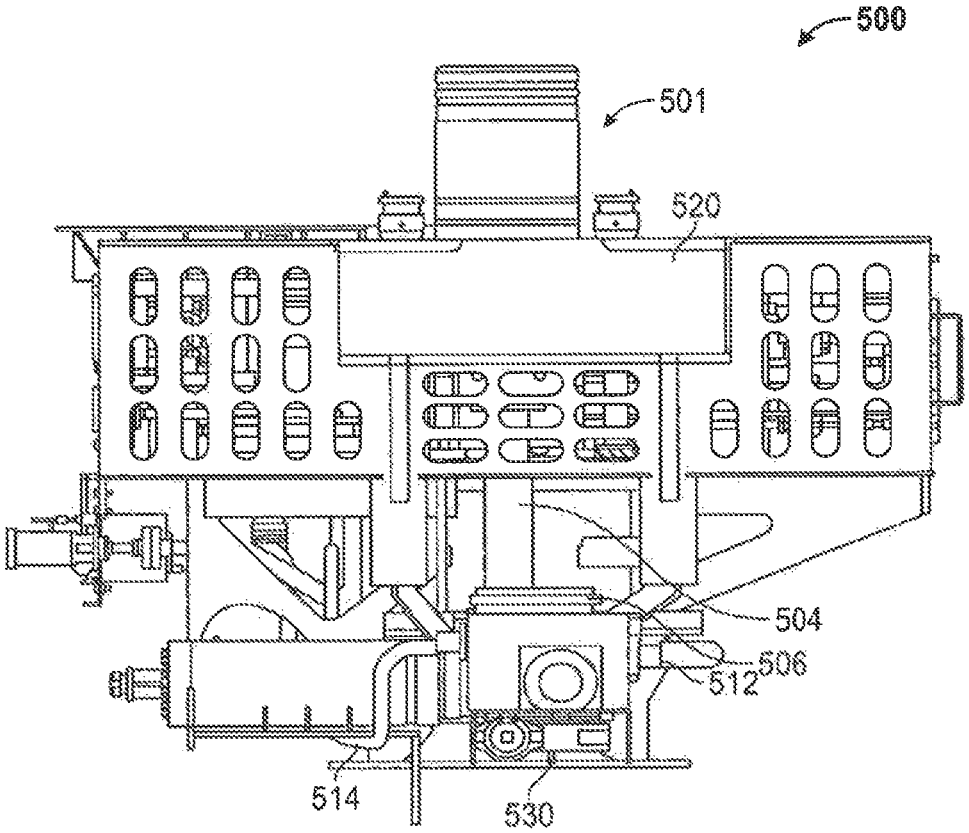
FIG. 24 is a side view of the system of FIG. 23 showing the support and fluid coupling interface for the retrievable fluid processing module.
Figure 25:
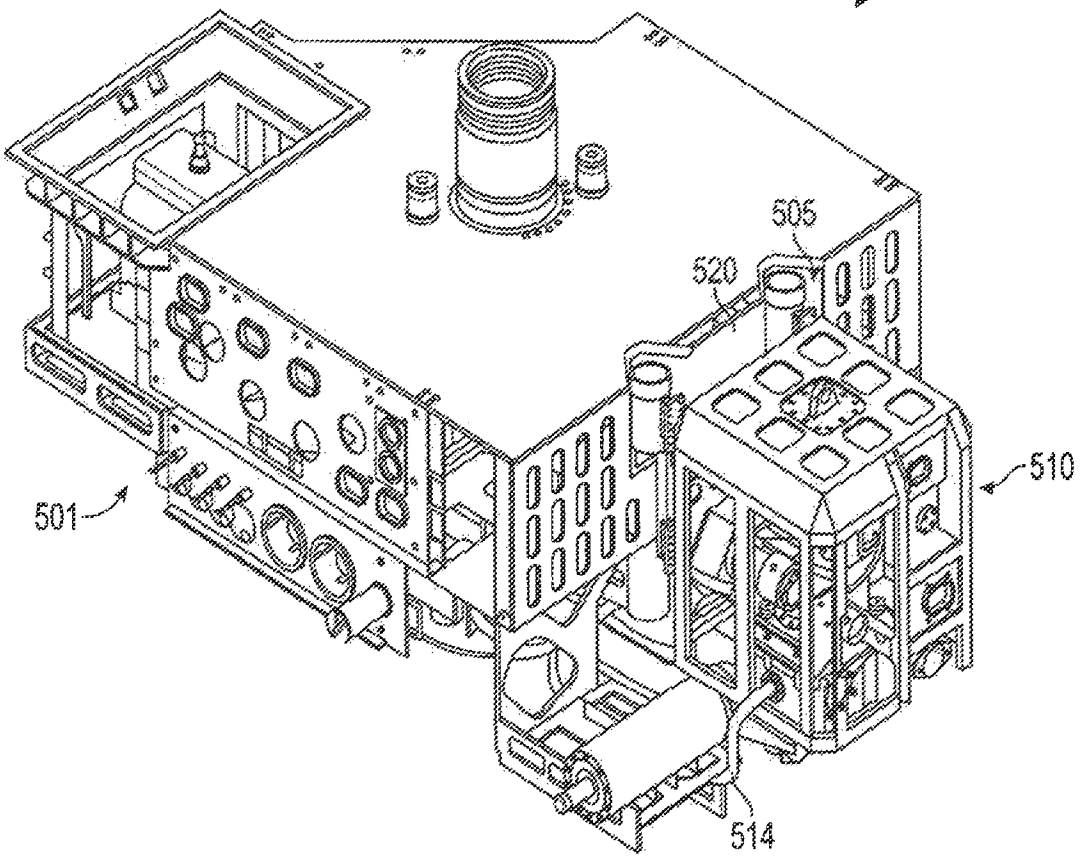
FIG. 25 is a perspective view of the system of FIG. 23 showing the retrievable fluid processing module coupled into the interface and ultimately to the vertical valve tree through the interface.

Referring now to FIG. 23, a system 500 for providing an interface between a wellhead valve tree structure 501 and a retrievable fluid processing module 510 is shown. The system 500 includes the tree structure 501 and an interface 505. In some embodiments, the tree structure 501 includes a vertical tree. The interface 505 includes a hub 506 and a receptacle and support structure 520. The hub 506 is fluidly coupled to a fluid conduit 504, as well as fluid conduits 512, 514. The fluid conduits 504, 512, 514 traverse across the interface 505 to couple to the tree 501. As shown in FIG. 24, the interface 505 includes the hub 506 and the support structure 520. Referring now to FIG. 25, a retrievable processing module 510 is installed at the interface 505 such that it is physically supported by the support structure 520 and is fluidly coupled to the tree 501 by the hub 506. The hub 506 is coupled to fluid conduit 504 such that fluids can traverse the interface 505 between the module 510 and the tree 501. Additional conduits 512, 514 may also traverse the interface 505 between the module 510 and the tree 501. In some embodiments, the conduit 504 is a production line from the tree 501, the conduit 512 is an outgoing flowline, and the conduit 514 and other conduits are other flowlines as described more fully below. In some embodiments, a platform 530 is provided below the hub 506.

Figure 26:
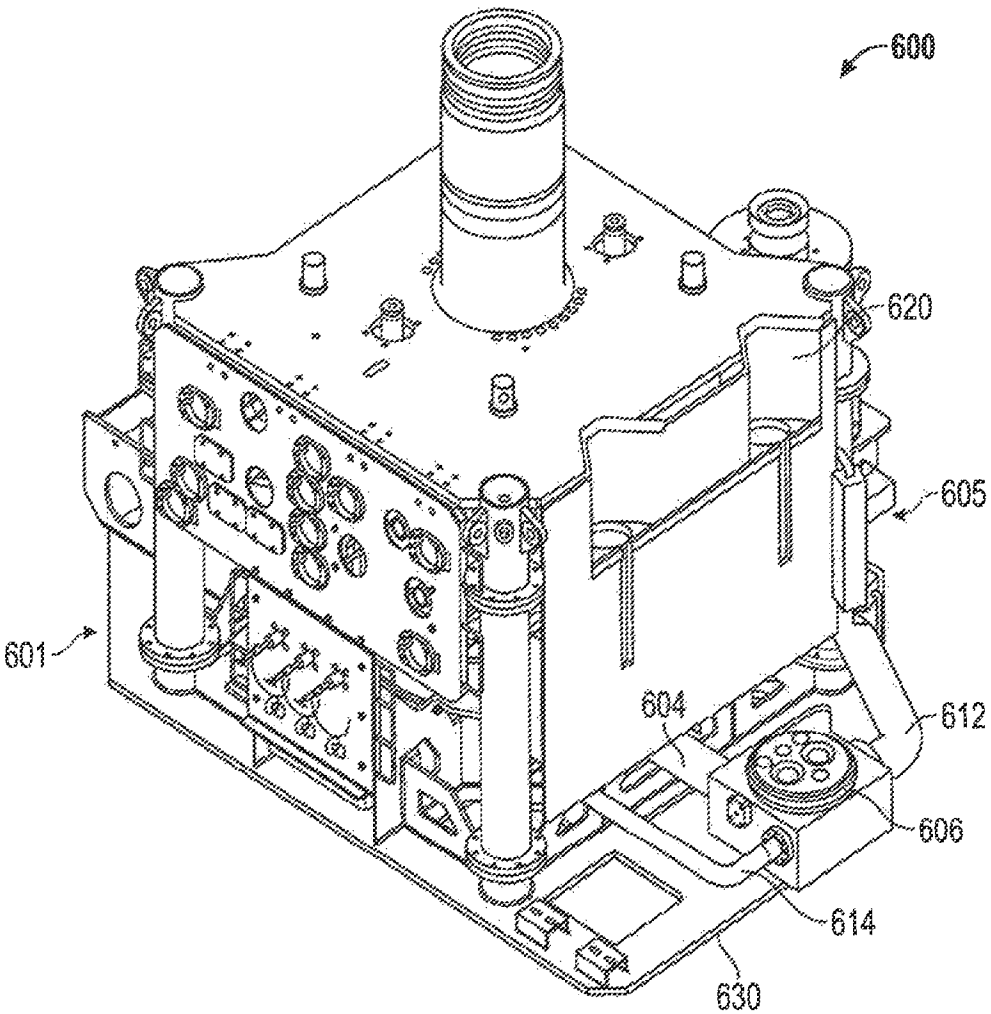
FIG. 26 is a perspective view of an embodiment a horizontal wellhead valve tree structure and retrievable fluid processing module interface system.
Figure 27:
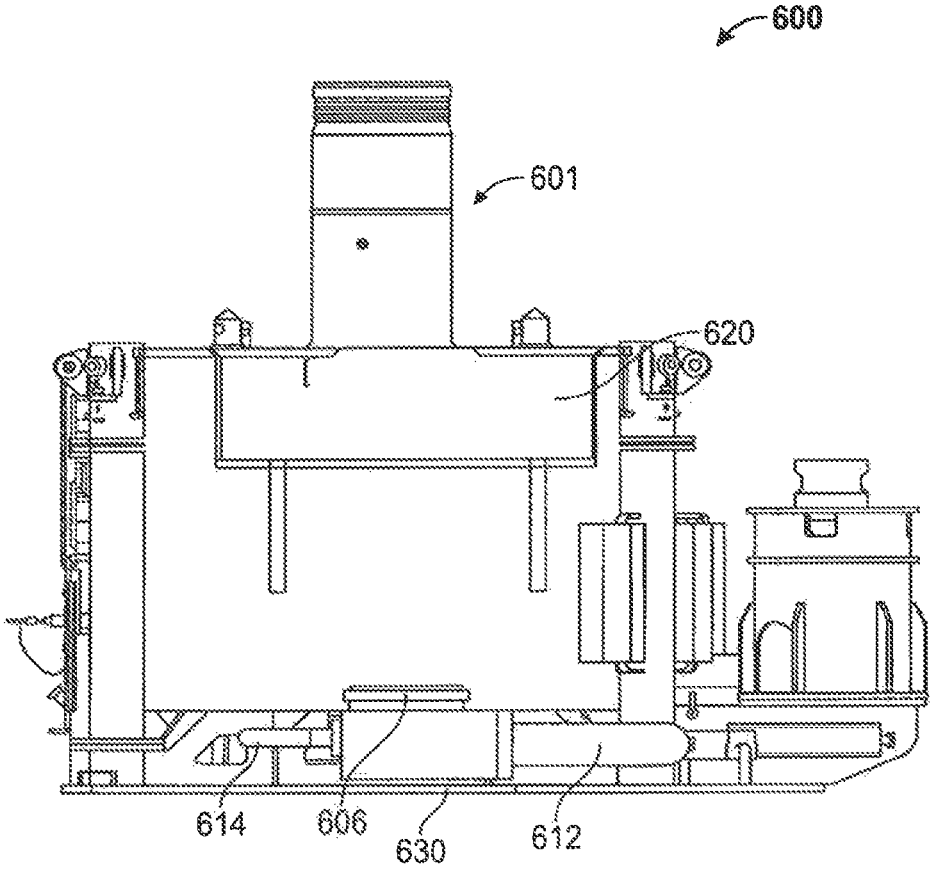
FIG. 27 is a side view of the system of FIG. 26 showing the support and fluid coupling interface for the retrievable fluid processing module.
Figure 28:
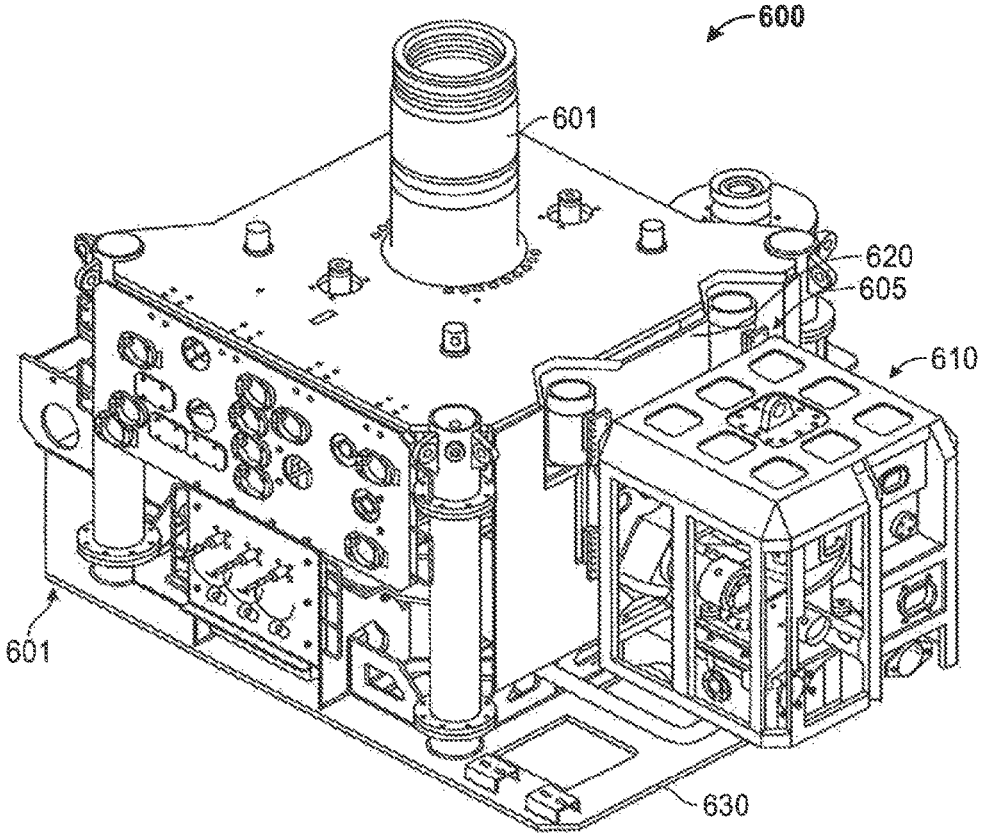
FIG. 28 is a perspective view of the system of FIG. 26 showing the retrievable fluid processing module coupled into the interface and ultimately to the horizontal valve tree through the interface.

Referring next to FIG. 26, a system 600 for providing an interface between a wellhead valve tree structure 601 and a retrievable fluid processing module 610 is shown. The system 600 includes the tree structure 601 and an interface 605. In some embodiments, the tree structure 601 includes a horizontal tree. The interface 605 includes a hub 606 and a receptacle and support structure 620. The hub 606 is fluidly coupled to a fluid conduit 604, as well as fluid conduits 612, 614. The fluid conduits 604, 612, 614 traverse across the interface 605 to couple to the tree 601. As shown in FIG. 27, the interface 605 includes the hub 606 and the support structure 620. Referring now to FIG. 28, a retrievable processing module 610 is installed at the interface 605 such that it is physically supported by the support structure 620 and is fluidly coupled to the tree 601 by the hub 606. The hub 606 is coupled to fluid conduit 604 such that fluids can traverse the interface 605 between the module 610 and the tree 601. Additional conduits 612, 614 may also traverse the interface 605 between the module 610 and the tree 601. In some embodiments, the conduit 604 is a production line from the tree 601, the conduit 612 is the outgoing flowline, and the conduit 614 and other conduits are other flowlines as described more fully below. In some embodiments, a platform 630 is provided below the hub 606.

Figure 29:
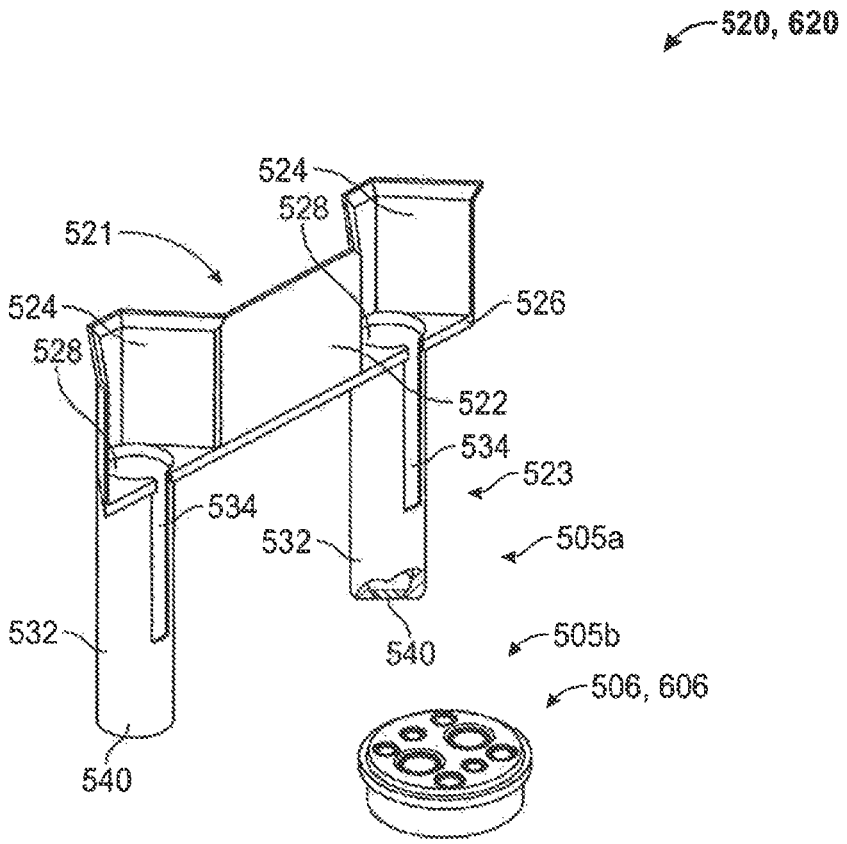
FIG. 29 is a perspective view of a module support structure and a fluid coupling hub that make up the primary portions of the interfaces of FIGS. 23-28.

Referring now to FIG. 29, details of the receptacle and support structures 520, 620 and the hubs 506, 606 are shown. It is noted that the discussion below may refer primarily to the system 500 and its components for ease of reference, though the principles described may apply equally to similar components and processes for the system 600. The support structure 520 includes an upper capture portion 521 and a lower retention portion 523. The upper capture portion 521 includes a capture plate 522 with capture wells or receptacles 524. The capture plate 522 is supported on a load bearing plate 526. The lower retention potion includes hollow cylinders 532 coupled to the load bearing plate 526 from below such that openings 528 extend through the load bearing plate 526. In some embodiments, the cylinders 532 are ten inch schedule 80 pipe. The cylinders 532 include axial slots 534 and landing bases 540 at their terminal or lower ends. The hubs 506, 606 are disposed near or in proximity to the support structures 520, 620 as previously shown in FIGS. 23-28. The support structures 520, 620 and the hubs 506, 606 form the primary portion of the interfaces 505, 605, wherein the support structures 520, 620 form a support interface portion 505*a* and the hubs 506, 606 form a fluid coupling interface portion 505*b*.

Figure 30:
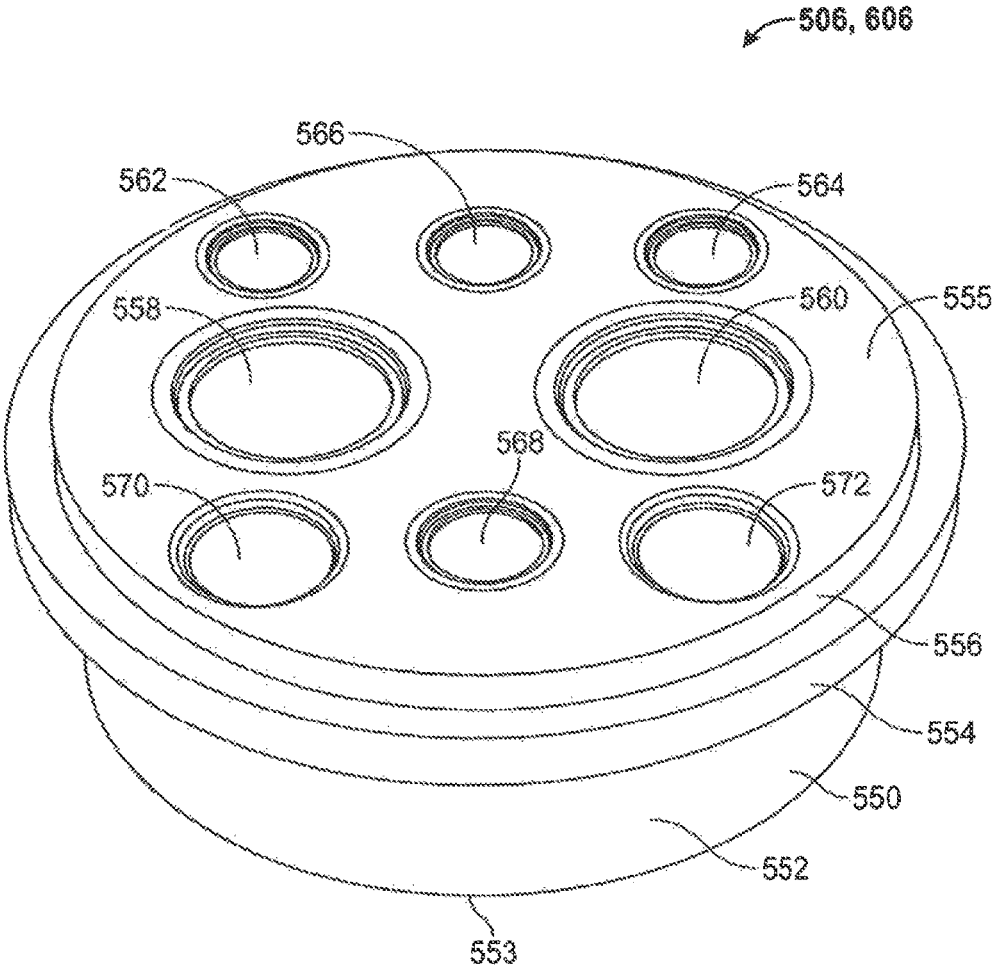
FIG. 30 is an enlarged perspective view of the fluid coupling hub of FIG. 29.

Referring now to FIG. 30, details of the hubs 506, 606 are shown. A hub body 550 includes a lower reduced diameter portion 552, a clamp profile or increased diameter portion 554, and an upper reduced diameter portion 556. In some embodiments, the clamp profile 554 includes a Destec G18SB claim profile. The body 550 includes a lower surface 553 and an upper surface 555. The upper surface 555 includes a series of openings, fluid ports, or fluid receptacles. A port 558 may be coupled to the production line from the valve tree and be an inlet to the retrievable processing module coupled to the hub 506. A port 560 may be coupled to the production flow line and be an outlet for the retrievable processing module coupled to the hub 506. In some embodiments, the ports 558, 560 are five inch bores with HD135 seal rings. A port 562 may be coupled to a first chemical injection line and a port 564 may be coupled to a second chemical injection line. In some embodiments, the chemical injection ports 562, 564 include one inch bores with HD60 seal rings. A port 566 may be coupled to a first gas lift line and be an inlet to the retrievable processing module coupled to the hub 506. A port 568 may be coupled to a second gas lift line and be an outlet for the retrievable processing module coupled to the hub 506. In some embodiments, the ports 566, 568 are two inch bores with HD60 seal rings. Finally, the upper surface 555 and the body 550 may include fine alignment pin receptacles 570, 572.

Figure 31:
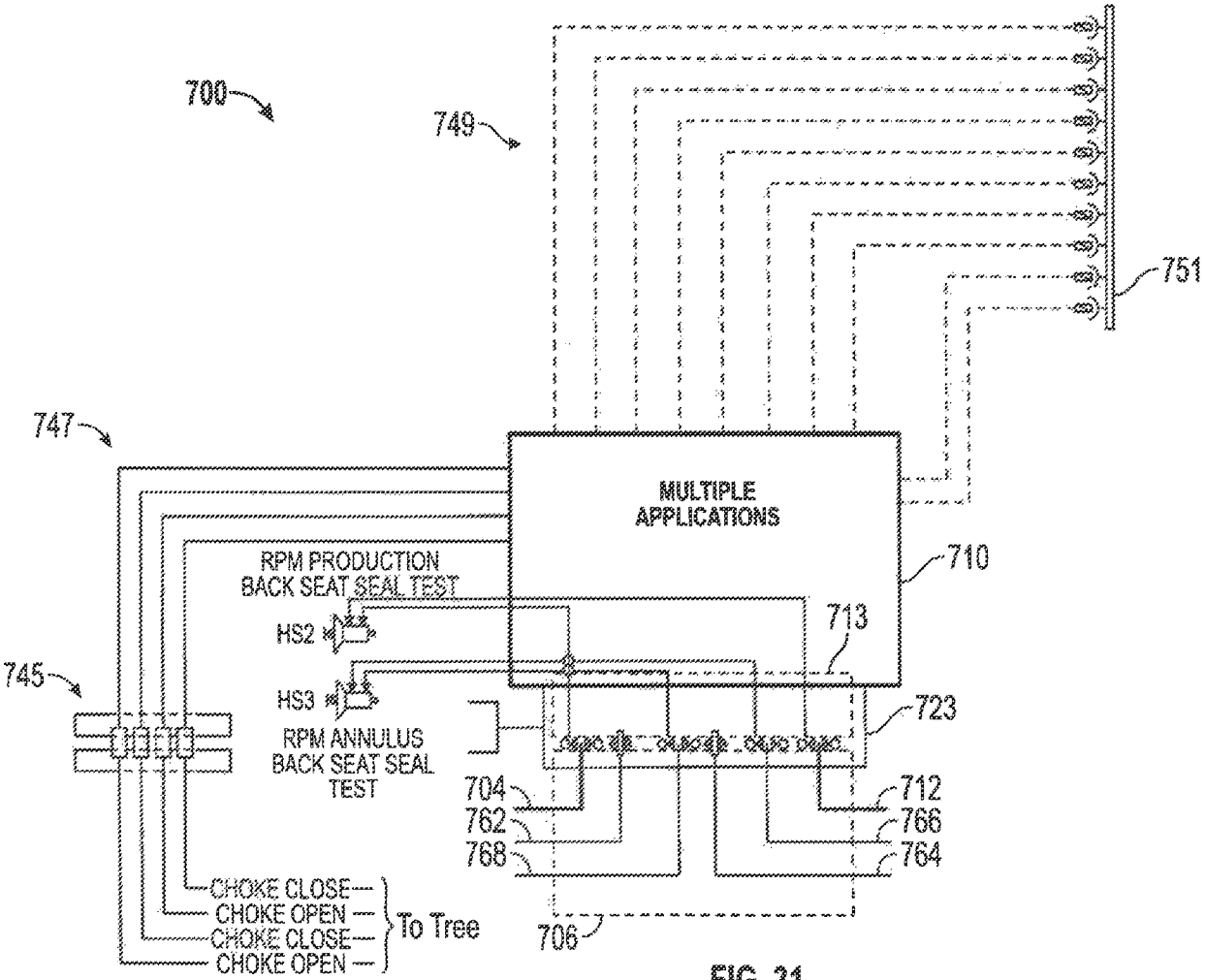
FIG. 31 is a schematic of an interface system between a generic, multiple application processing module and a valve tree via a fluid coupling interface.

The various ports and receptacles in the hub body 550 as just described couple to the flow lines of a tree and module system. Referring now to FIG. 31, a tree and module interface system 700 is shown schematically. A lower hub 706 is a fluid coupling interface with a valve tree as described elsewhere herein. A retrievable processing module 710 is similar to the other processing modules described herein, wherein a lower hub connector 713 of the module 710 couples to the hub 706 via a clamp 723. The made up connection 706, 713 includes a production inlet 704, a chemical injection inlet 762, a gas lift outlet 768, a production outlet 712, a gas lift inlet 766, and a chemical injection inlet 764 via the corresponding fluid ports of the hub body 550 of FIG. 30. Further fluid communication between the module 710 and the valve tree is provided by the fluid lines 747 and the associated junction plate 745. Electrical or other control communication is provided by the lines 749 coupled between the module 710 and a ROV panel 751 on the module 710. The module 710 is represented generally because it can be configured according to the various module embodiments described herein, and specifically in accordance with the various applications and configurations listed above in the discussion referencing the "supplemental module SM."

Figure 32:
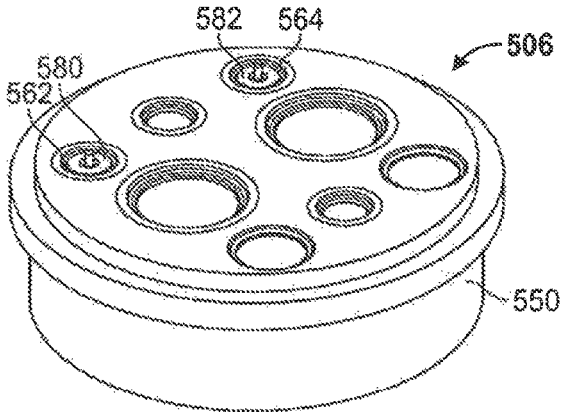
FIG. 32 is the fluid coupling hub of FIG. 30 including port couplers.
Figure 33:
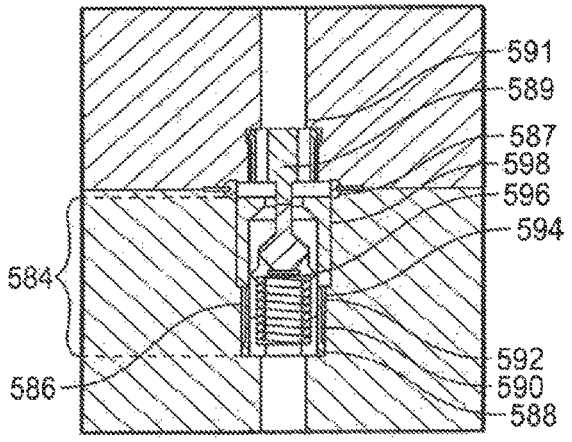
FIGS. 33 and 34 are alternative embodiments of the port couplers of FIG. 32 including poppet valves.
Figure 34:
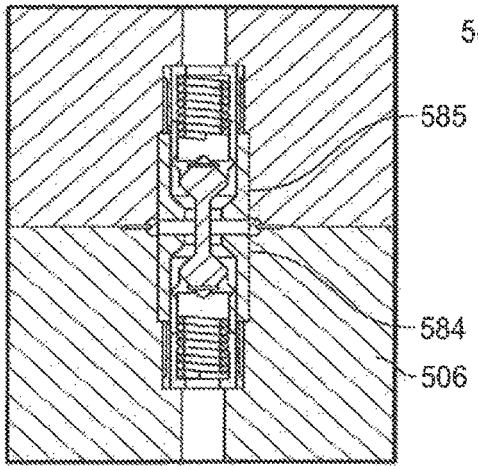

Referring now to FIG. 32, the hub 506 may include a chemical injection coupler 580 in the first chemical injection port 562 and a chemical injection coupler 582 in the second chemical injection port 564. In some embodiments, as shown in FIG. 33, the couplers 580, 582 include a lower poppet assembly 584. The poppet assembly 584 is threaded into the hub body 550 at threads 586. The poppet assembly 584 includes a poppet housing and retainer 598, a spring seat 590, a spring seat retainer clip 588, a spring 592, an elastomer seal 594, and a poppet 596. The upper hub connector such as those described herein may include a dummy poppet 589 adjacent an upper bore 591 and sealed against the lower poppet housing 598 by a seal 587. In other embodiments, the lower popper assembly 584 in the hub 506 is sealed against an upper poppet assembly 585 in the upper hub connector as shown in FIG. 34.

Figure 35:
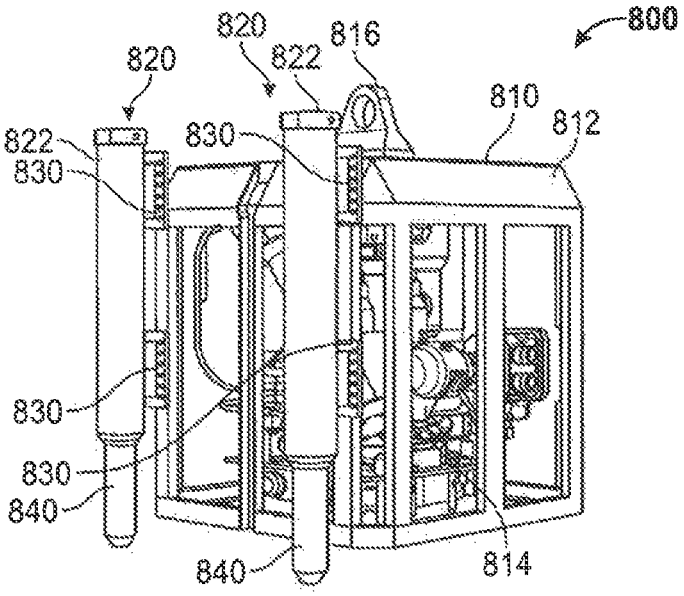
FIG. 35 is an embodiment of a retrievable fluid processing module having a soft landing and controlled descent system.

Referring now to FIG. 35, an embodiment of a soft land and controlled descent system for a retrievable processing module is shown. A module system 800 includes a processing module 810 including a primary frame body 812 and processing apparatus 814. The frame body 812 includes a lift eye 816 to receive a lifting crane apparatus. A soft landing and controlled descent system 820 is coupled to the frame body 812 at couplings 830. The landing system 820 includes cylinders 822 that receive cartridges 840 which will be described more fully below.

Figure 36:
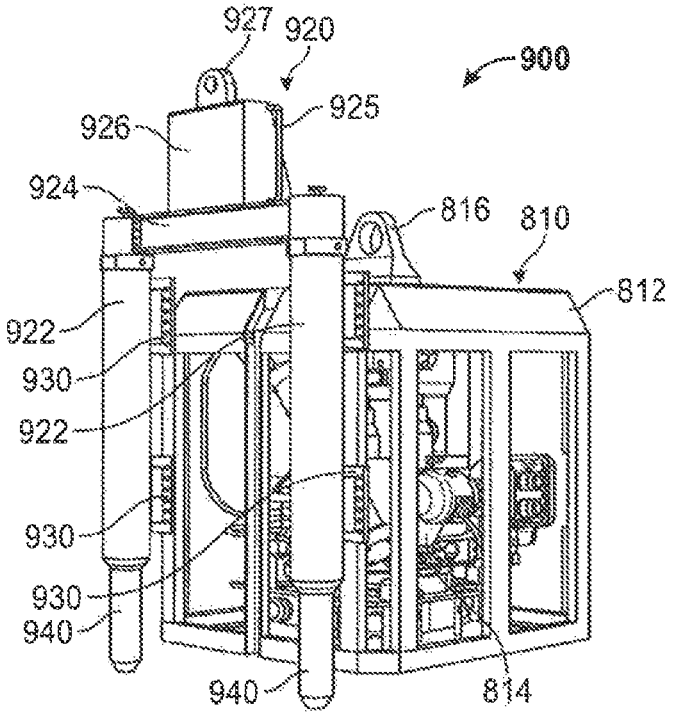
FIG. 36 is another embodiment of a retrievable fluid processing module having a soft landing and controlled descent system with a running tool.
Figure 38:
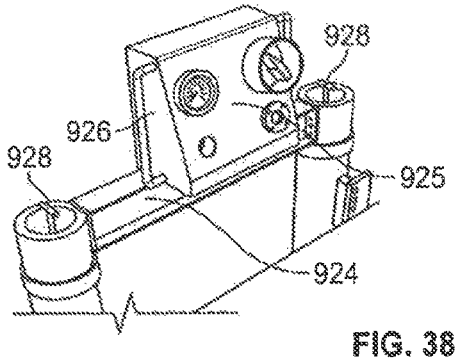
FIG. 38 is an enlarged view of the upper portion of the running tool of FIG. 36.

Referring now to FIG. 36, another embodiment includes a module system 900 having a soft landing and controlled descent system 920. Rather than the cartridges 840 being fixed to the frame body 812, the landing system 920 includes receiver cylinders 922 that are coupled to the frame body 812 by couplings 930 while cartridges 940 are removable from the cylinders 922 via a running tool 926. The running tool 926 includes a support member 924, a ROV panel 925, and lifting eye 927. Consequently, the tops of the cylinders 922 are open to receive the cylinders 940, whereas the tops of the cylinders 822 are closed or sealed off. Referring to FIG. 38, the running tool 926 is enlarged to show the support member 924, the ROV panel 925, and latching mechanisms 928 that may be ROV operated. Consequently, the landing system 920 can be coupled onto the module 810 and also is retrievable therefrom.

Figure 37:
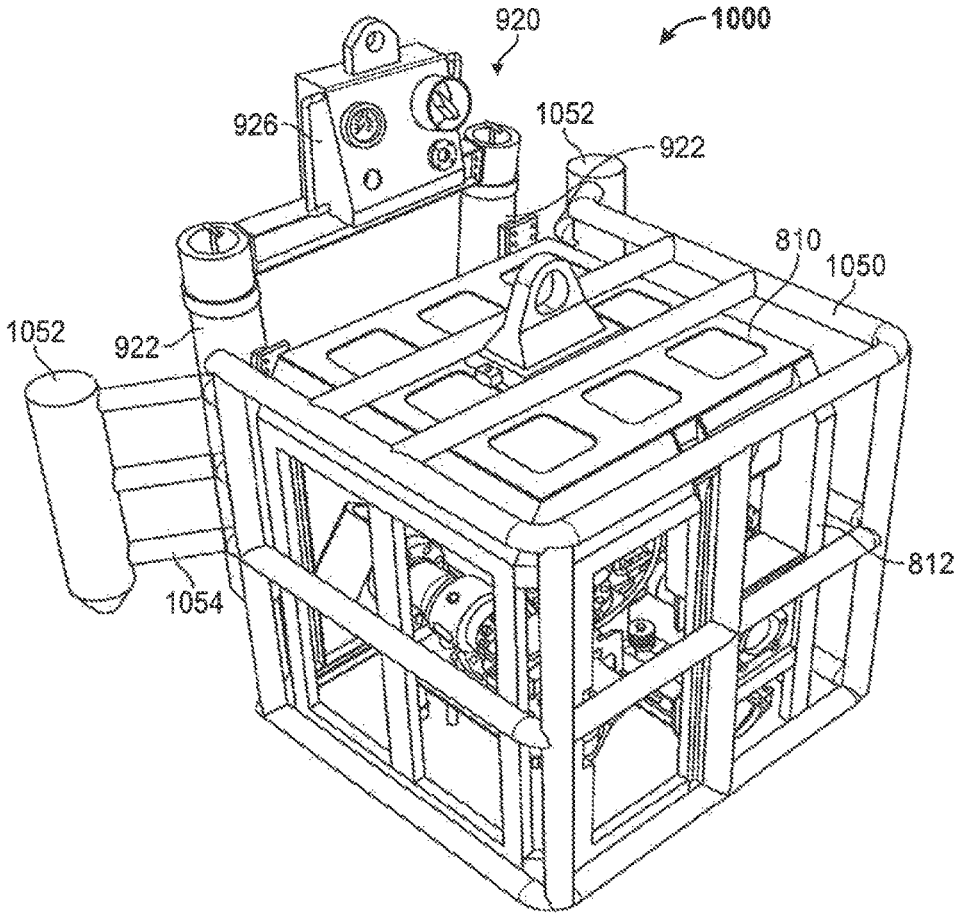
FIG. 37 is an embodiment of a retrievable fluid processing module having a soft landing and controlled descent system and a protection frame.

Referring now to FIG. 37, yet another embodiment includes a module system 1000 having the soft landing and controlled descent system 920 as previously described. The system 1000 further includes a protection frame 1050 coupled about the module frame body 812. The protection frame 1050 includes alignment posts 1052 coupled to the frame 1050 via couplers 1054. Though the module system 1000 is shown with the retrievable tool version 920 of the landing system, the module system 1000 may also include the fixed landing system 820 in place of the retrievable landing system 920.

Figure 41:
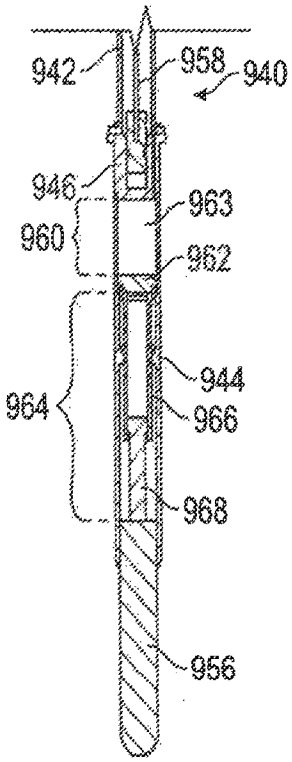
FIG. 41 is a cross-section view of the cartridges of FIG. 39.
Figure 40:
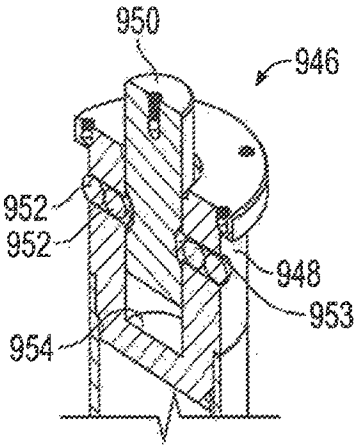
FIG. 40 is an enlarged view of the running tool latch of FIG. 39.
Figure 39:
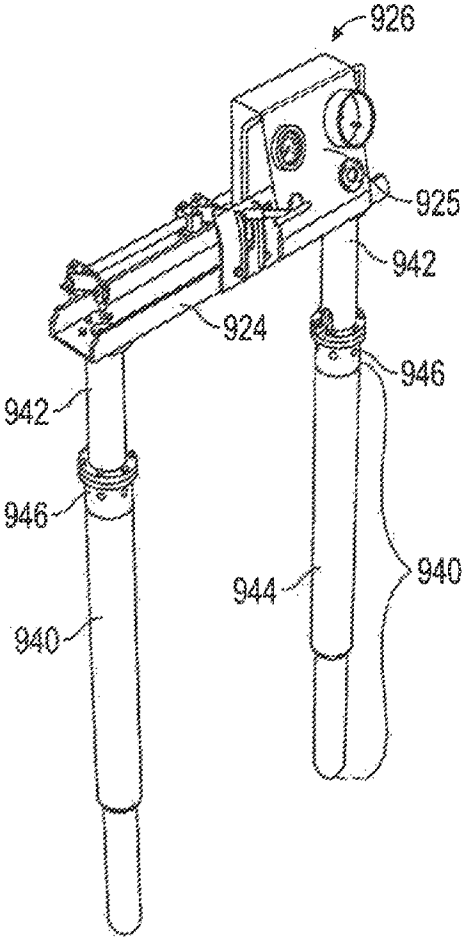
FIG. 39 is an enlarged perspective view of the running tool of FIGS. 36 and 38.

Referring now to FIG. 39, the running tool 926 is shown in more detail. The running tool 926 includes a support structure or member 924 that may include a lift point (not shown; lifting eye 927 shown in FIGS. 36 and 37). The ROV panel 925 is mounted on the support structure 924 and includes hydraulic controls and latching controls. Adapters 942 couple the support structure 924 to the cartridges or soft land cartridges 940 via ball lock latches 946. The cartridges 940 include outer housings 944. As shown in the cross-section of FIG. 40, the ball lock latch 946 includes a housing 948 having an inner bore 954 that forms an inner cavity with the inner member 950. Balls 952 are disposed in the housing 948 radially about the inner member 950 and can interface with the inner member 950 at 953. In FIG. 41, a cross-section of the cartridge 940 shows inner details. The housing 944 includes a hydraulic cylinder portion 960 and a water damper portion 964. As will be discussed, the hydraulic cylinder portion 960 provides active lowering of the retrievable processing module, while the water damper portion 964 provides a passive soft landing. An end member 956 seals the lower portion of the housing 944. The water damper 964 includes a water chamber 966 and a piston rod 968 to move or stroke within the water chamber 966. A piston 962 separates the water damper 964 from a hydraulic chamber 963 of the hydraulic cylinder 960. The ball lock latch 946 is a hydraulic connector to the hydraulic fluid line 958 that extends through the adapter 942.

Figure 42:
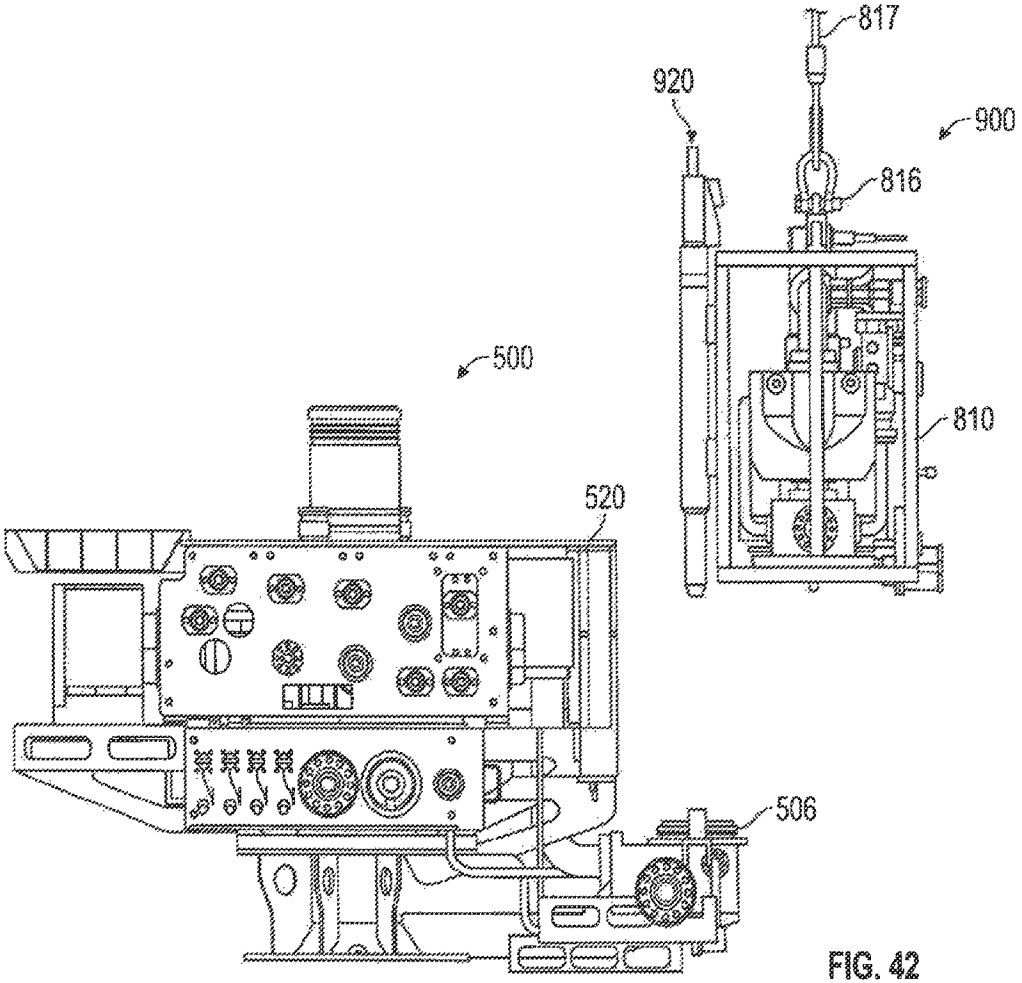
FIGS. 42-55 illustrate an embodiment of a landing and installation process for a retrievable processing module at a valve tree interface.
Figure 43:
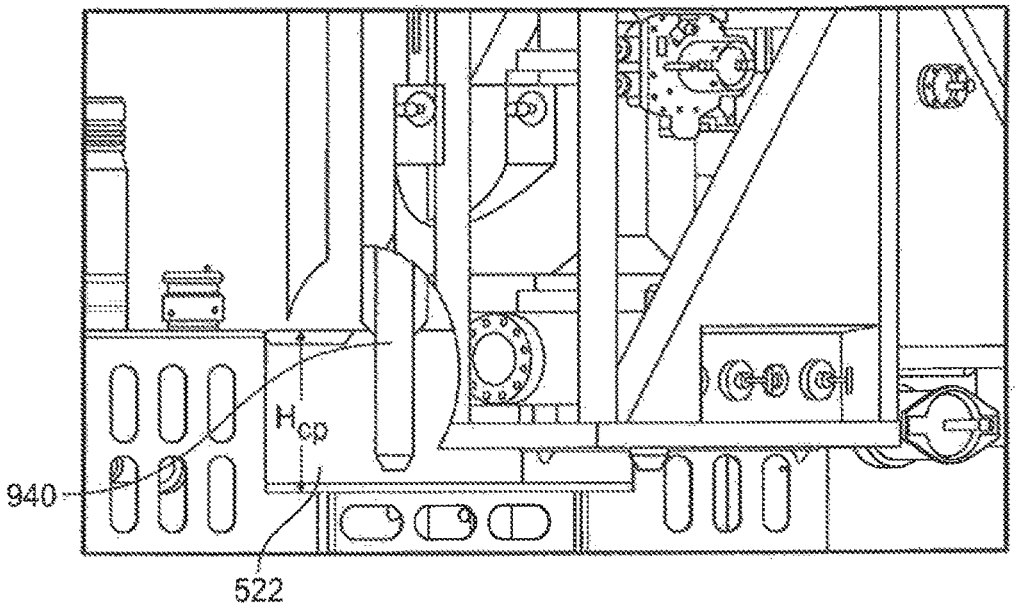
Figure 45:
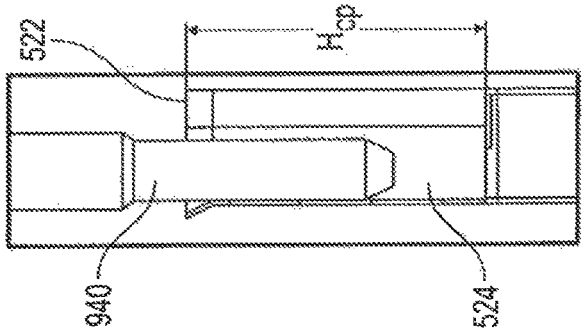
Figure 44:
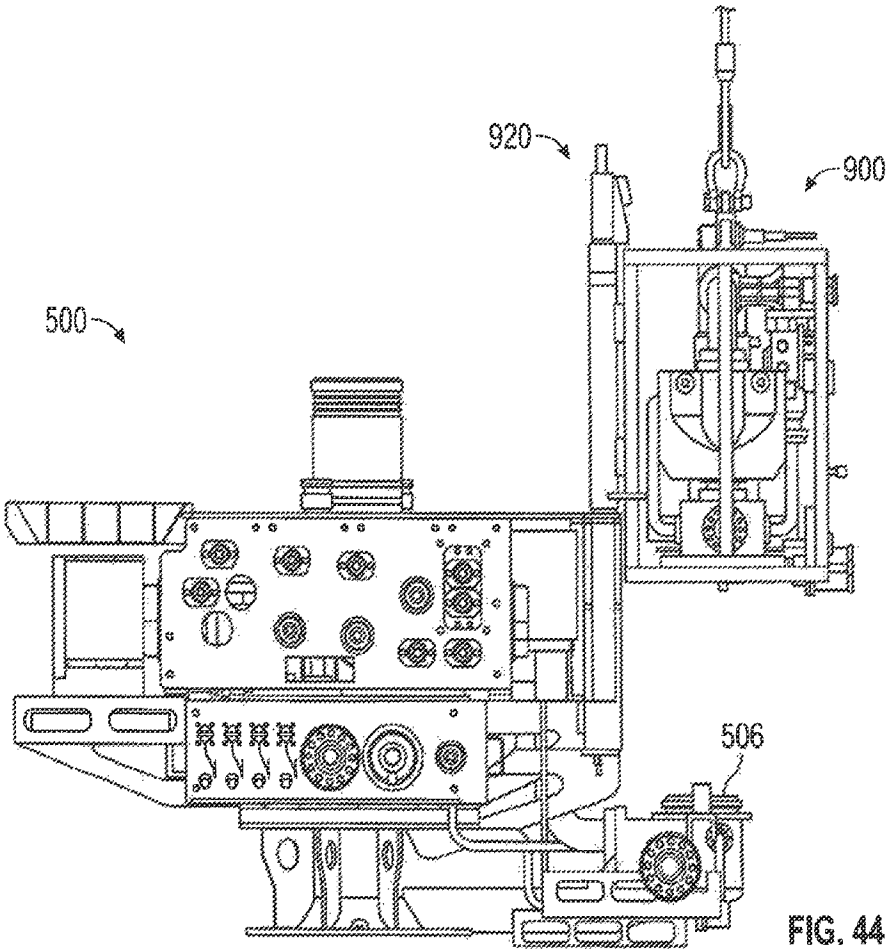
Figure 46:
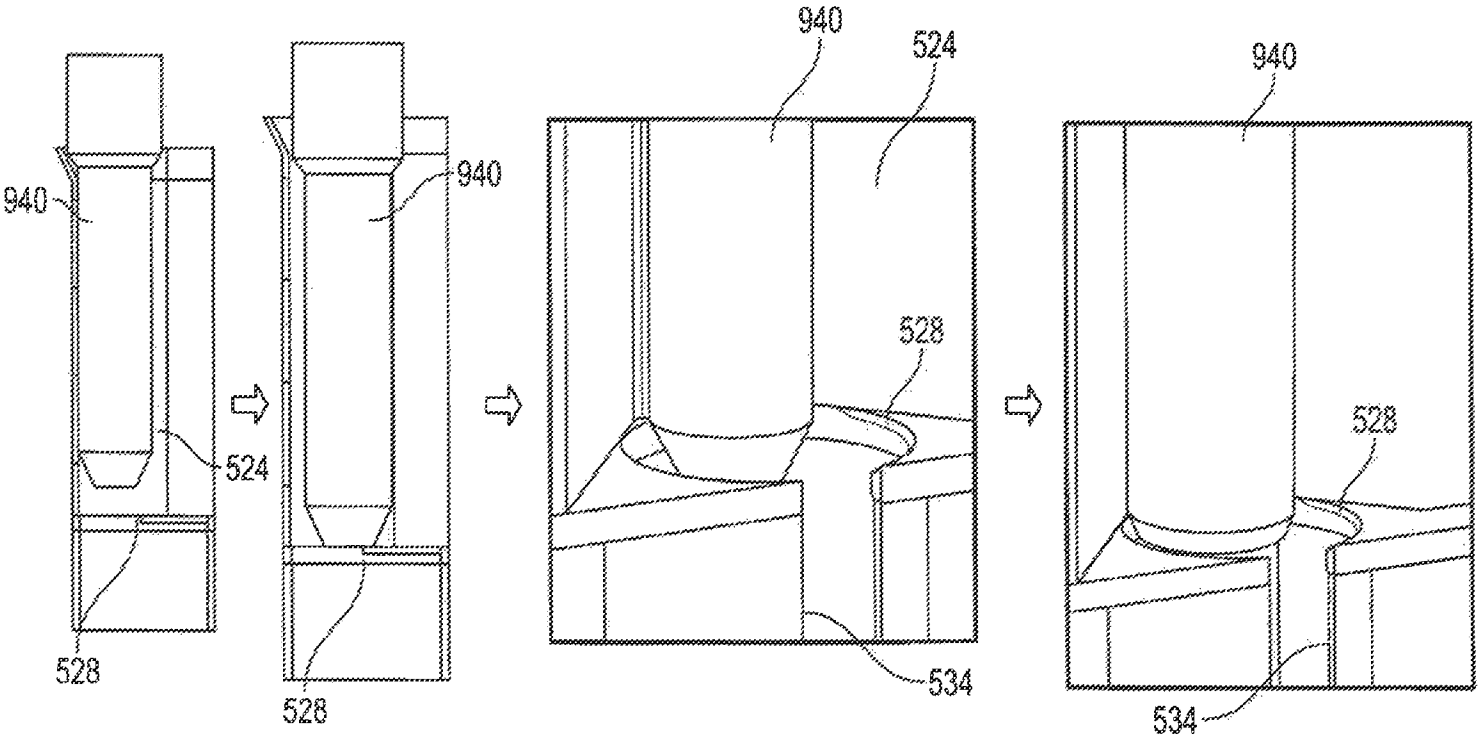

Referring now to FIG. 42, a process for installing a retrievable fluid processing module will be shown and described. For purposes of efficient description, the tree interface system 500 and the module system 900 will be used, though any of the various configurations of these systems as described herein may be used. The module system 900 including the retrievable processing module 810 is lowered by a crane 817 coupled at the lifting eye 816. The system 900 is lowered to a position away from the tree system 500. Next, a ROV pushes the system 900 toward the support structure interface 520 such that the system 900 is generally above the fluid coupling hub 506 and the cartridge 940 is positioned within a height $H_{cp}$ of the capture plate 522 of the support structure interface 520, as shown in FIG. 43. Referring to FIGS. 44 and 45, the ROV pushes the cartridge 940 of the module system 900 against the capture plate 522 in the capture well 524. As shown in FIG. 46, the module system 900 is lowered such that the cartridge 940 is moved downward in the capture well 524 toward the cylinder opening 528 until the end of the cartridge 940 is inserted into the opening 528. As shown, any potential hang-ups are removed or minimized.

Figure 47:
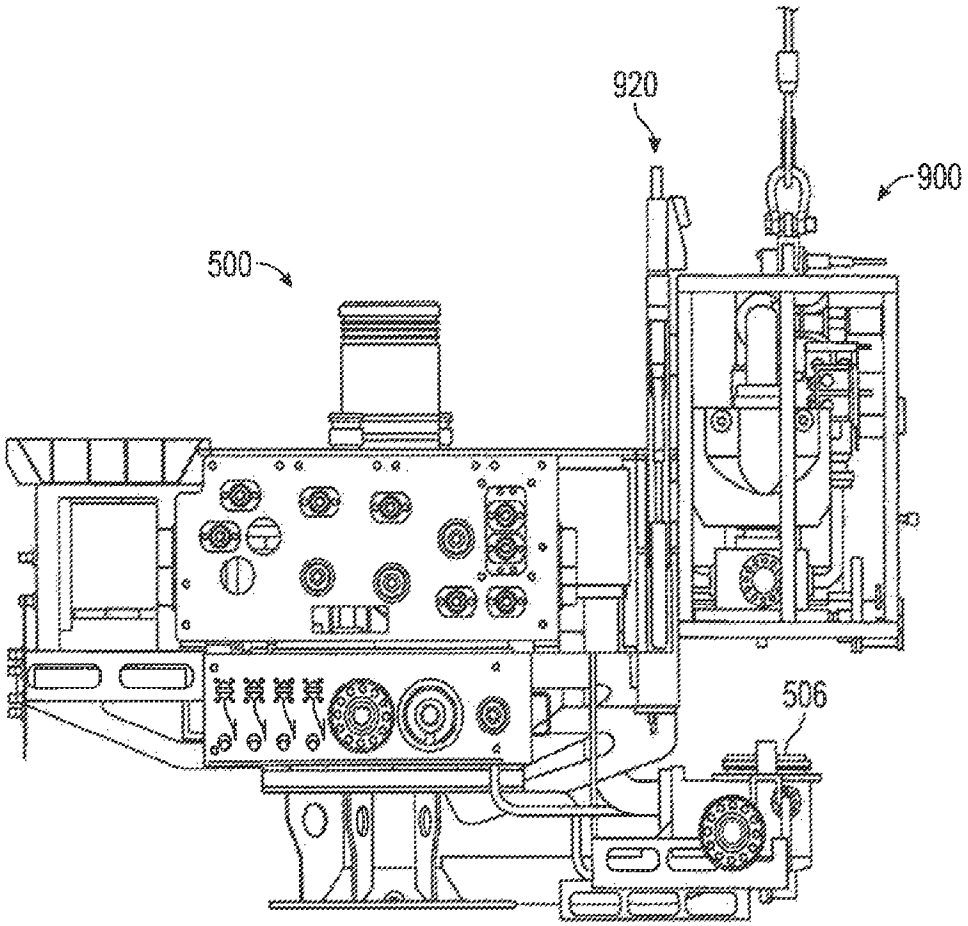
Figure 48:
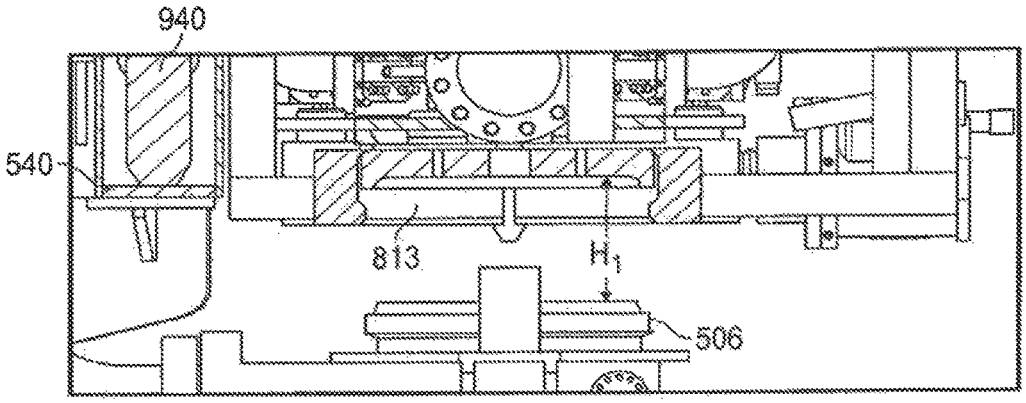
Figure 49:
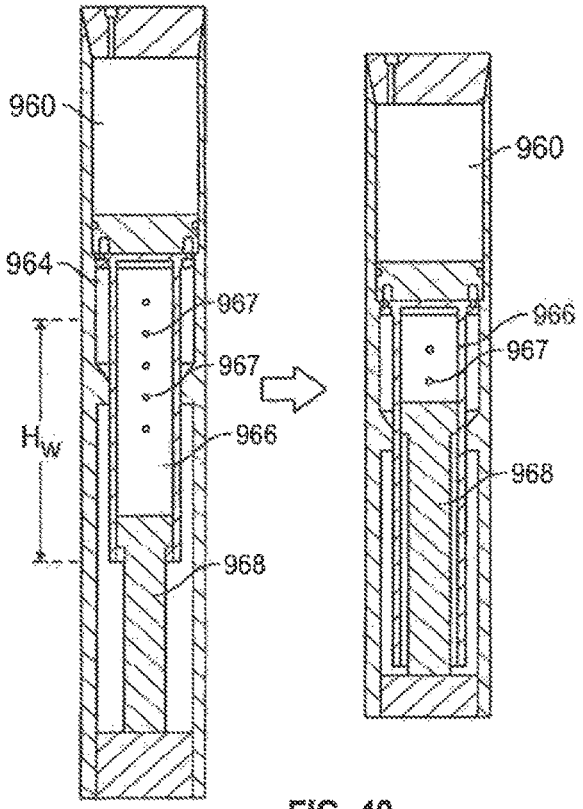
Figure 50:
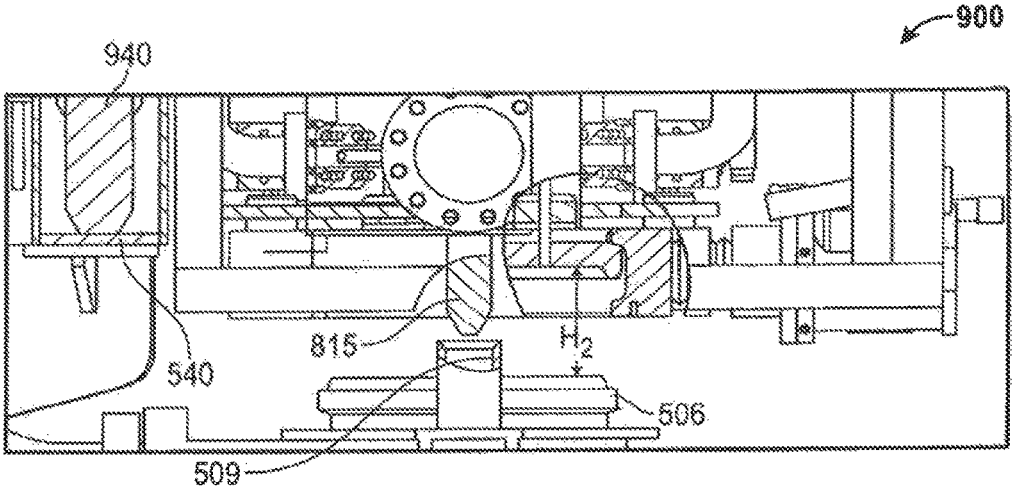

Referring now to FIG. 47, the module system 900 and the landing system 920 have begun to engage in a soft or passive landing. As shown in FIG. 48, the cartridge 940 has landed on or bottomed out on the landing base 540. At such a time, an upper face of the hub 506 is at a distance $H_1$ from a lower face of a module system hub 813. As the weight of the system 900 is reacted against the cartridges 940, the water damper 964 provides a controlled deceleration of the system 900. As shown in FIG. 49, water in the water chamber 966 is pushed out of the water chamber 966 by the moveable piston rod 968 through holes 967. Because of the size and spacing of the holes 967, the holes 967 act as a flow restriction for the water flow path. The distance $H_w$ is reduced as the piston rod 968 moves within the water chamber 966. As shown in FIG. 50, the module system 900 is lowered corresponding to the passive dampening of the cartridge 940 such that the distance $H_1$ is reduced to distance $H_2$ and a fine alignment pin 815 of the module system 900 is brought into proximity to a pin receptacle 509 of the hub 506. The difference between distance $H_1$ and distance $H_2$ is also the reduction in the distance $H_w$ of the water damper 964. In some embodiments, the distance $H_1$ is approximately 20 inches and the distance $H_2$ is approximately 10 inches.

Figure 51:
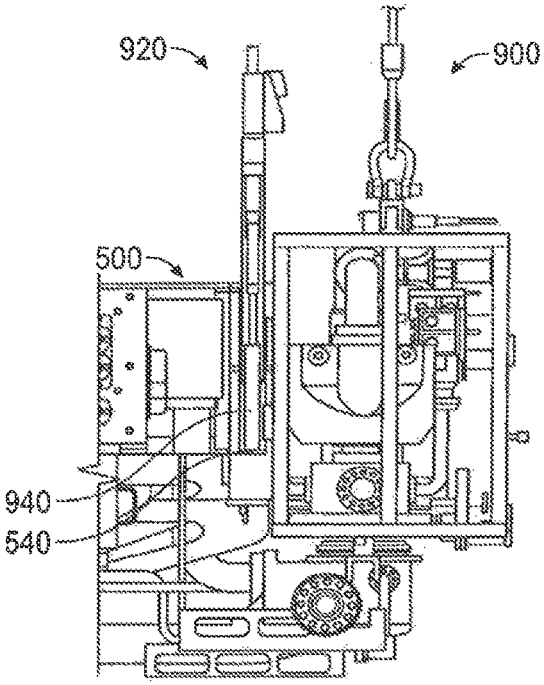
Figure 52:
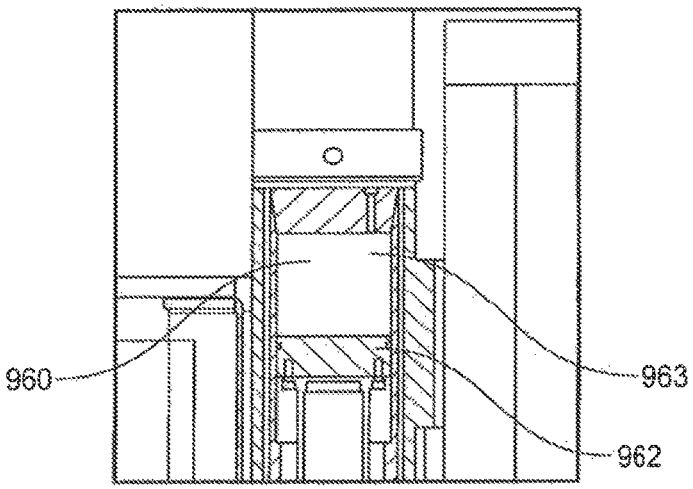
Figure 53:
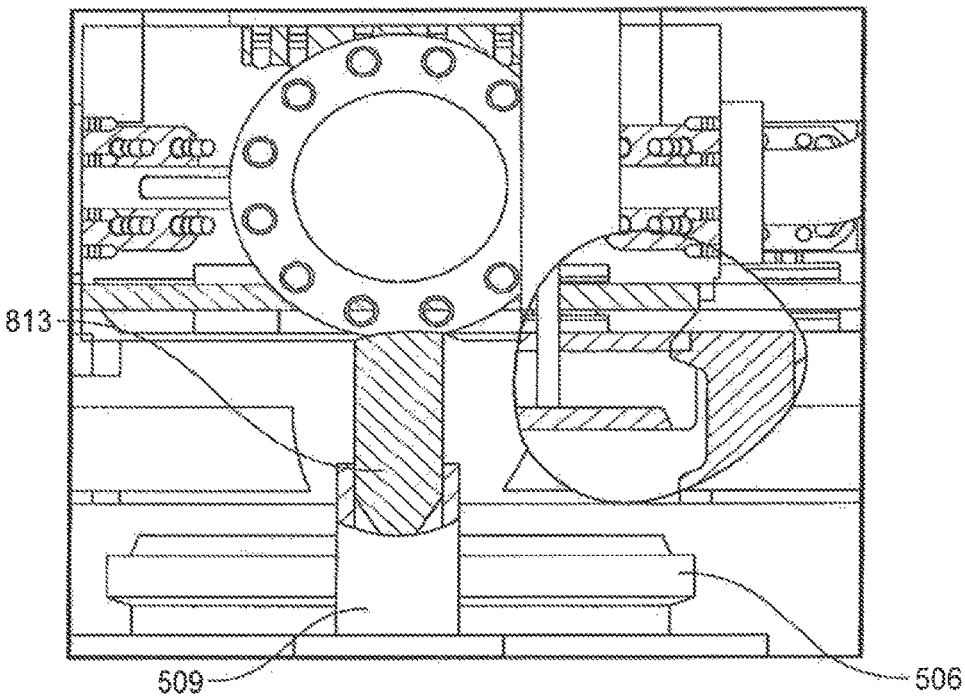
Figure 54:
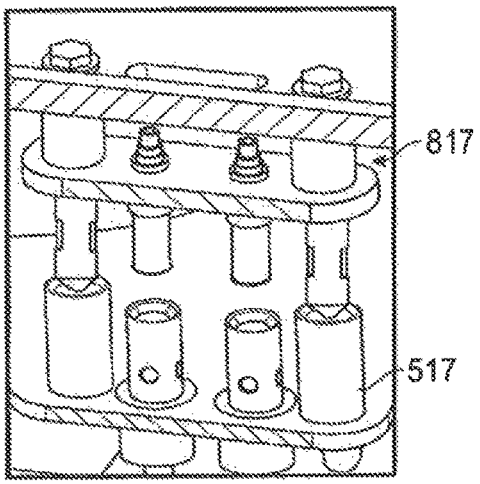
Figure 55:
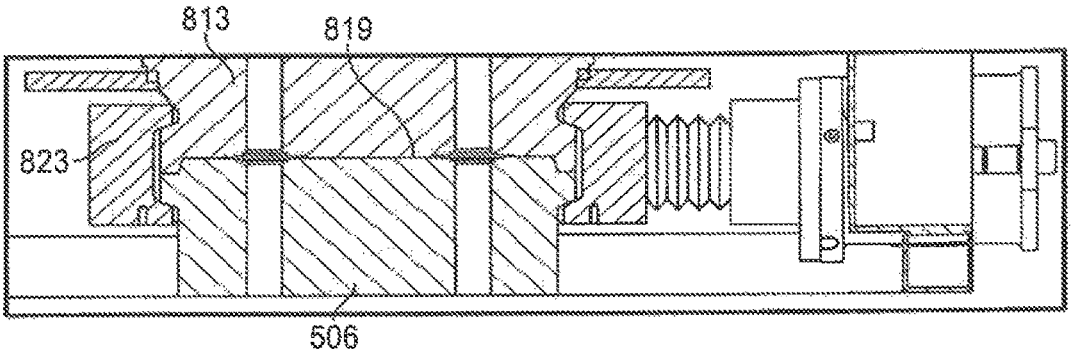

Referring now to FIG. 51, the module system 900 and the landing system 920 have now begun to engage in an active or dynamic portion of the landing. The cartridges 940 continue to be bottomed out on the landing bases 540. Referring now to FIG. 52, the hydraulic cylinders may now be engaged to bleed hydraulic fluid from the hydraulic chamber 963 and further reduce the length or stroke of the cartridges 940, thereby continuing to lower the module system 900. As shown in FIG. 53, such active hydraulic lowering of the module system 900 allows the fine alignment pin 813 to contact and engage the pin receptacle 509, providing further alignment of the module system 900 on the hub 506. Consequently, couplers on the module system 900 contact and engage couplers on the tree interface 520, such as the module system couplers 817 and the interface couplers 517 as shown in FIG. 54. Finally, the module connector hub 813 engages the hub 506 to form a fluid transfer interface 819, coupled by a clamp 823.

Figure 56:
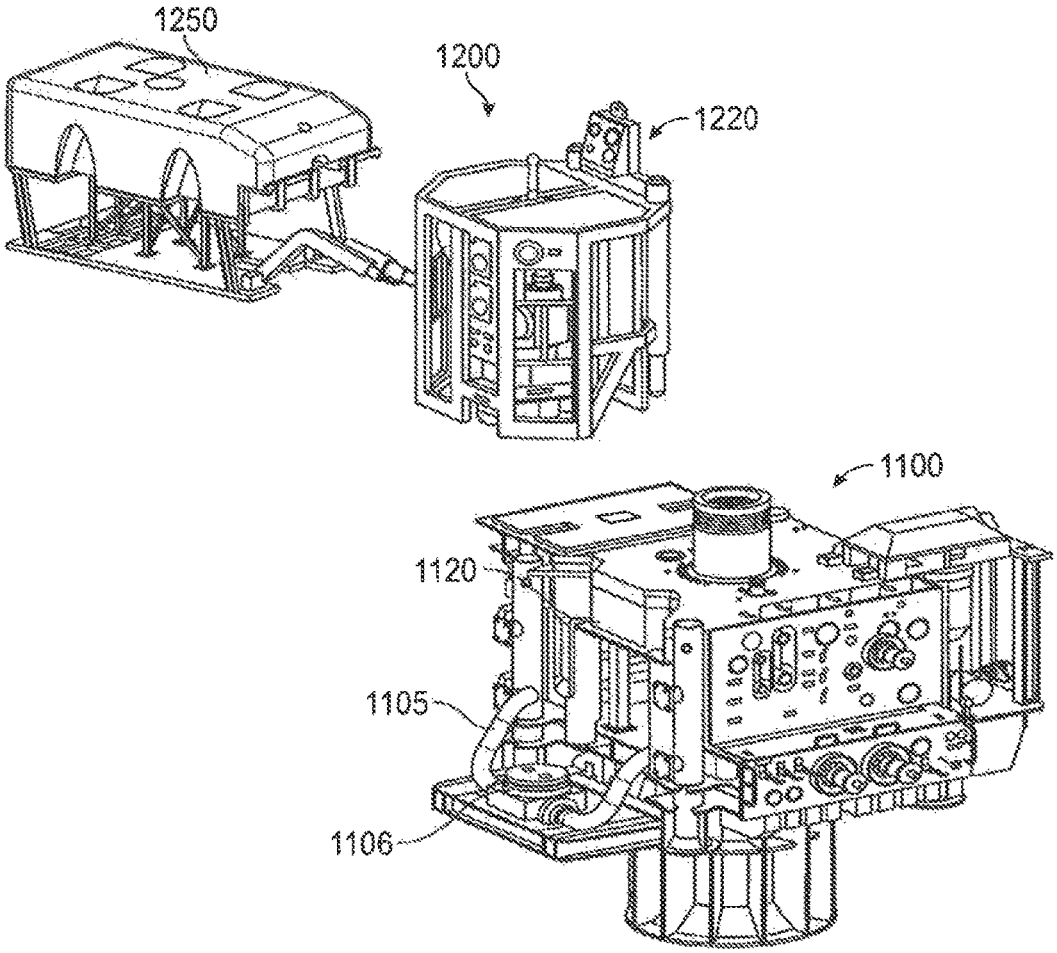
FIGS. 56-60 illustrate another embodiment of a landing, installation, and running tool retrieval process for a retrievable processing module at a valve tree interface.
Figure 57:
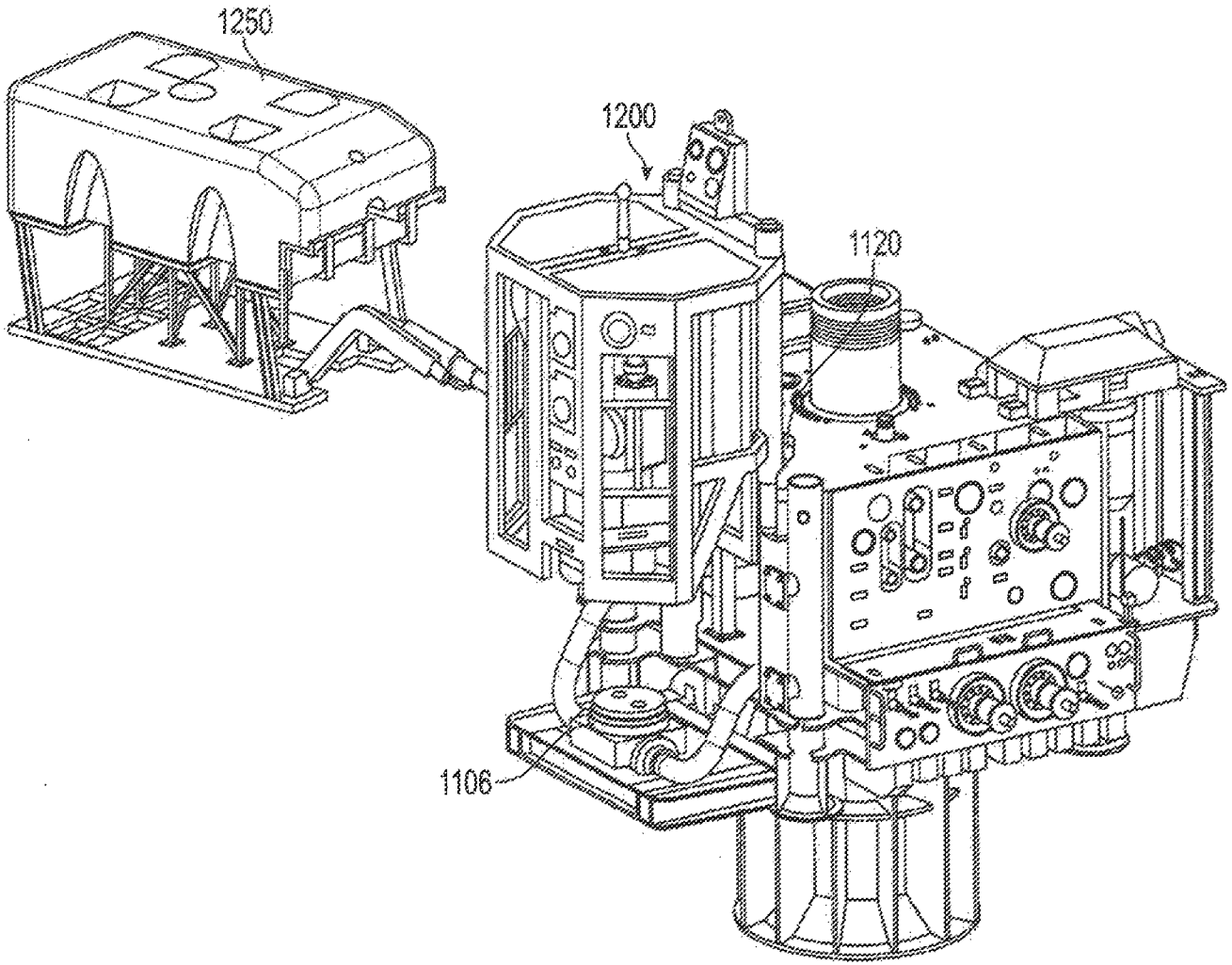
Figure 58:
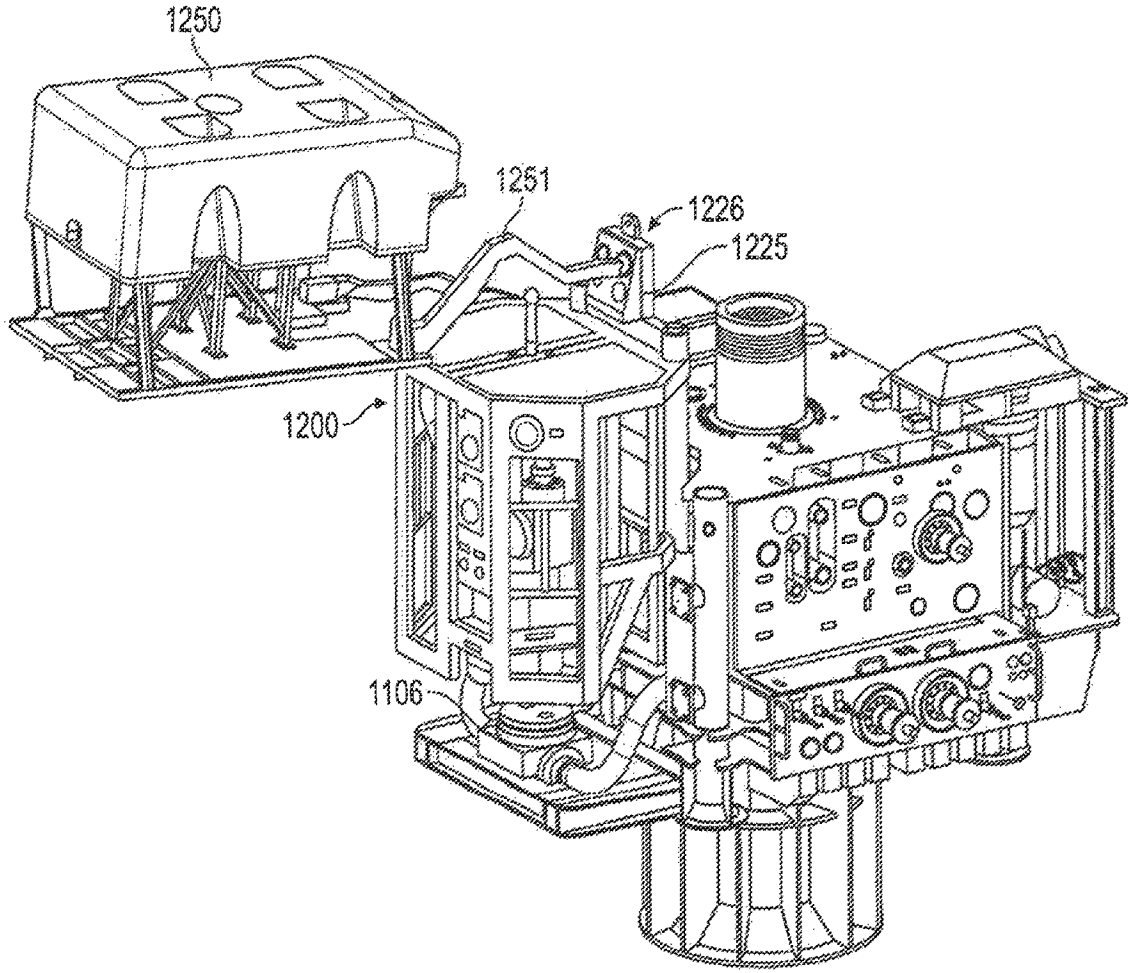
Figure 59:
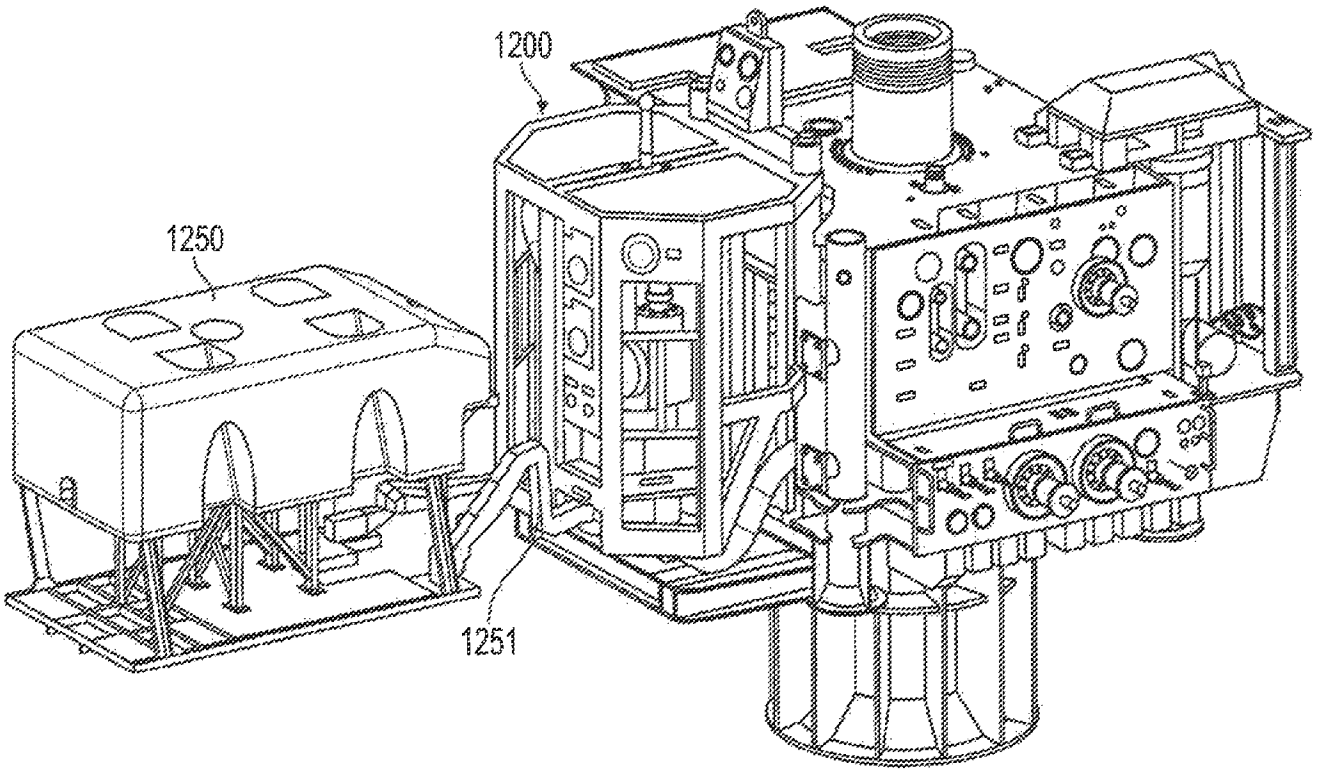
Figure 60:
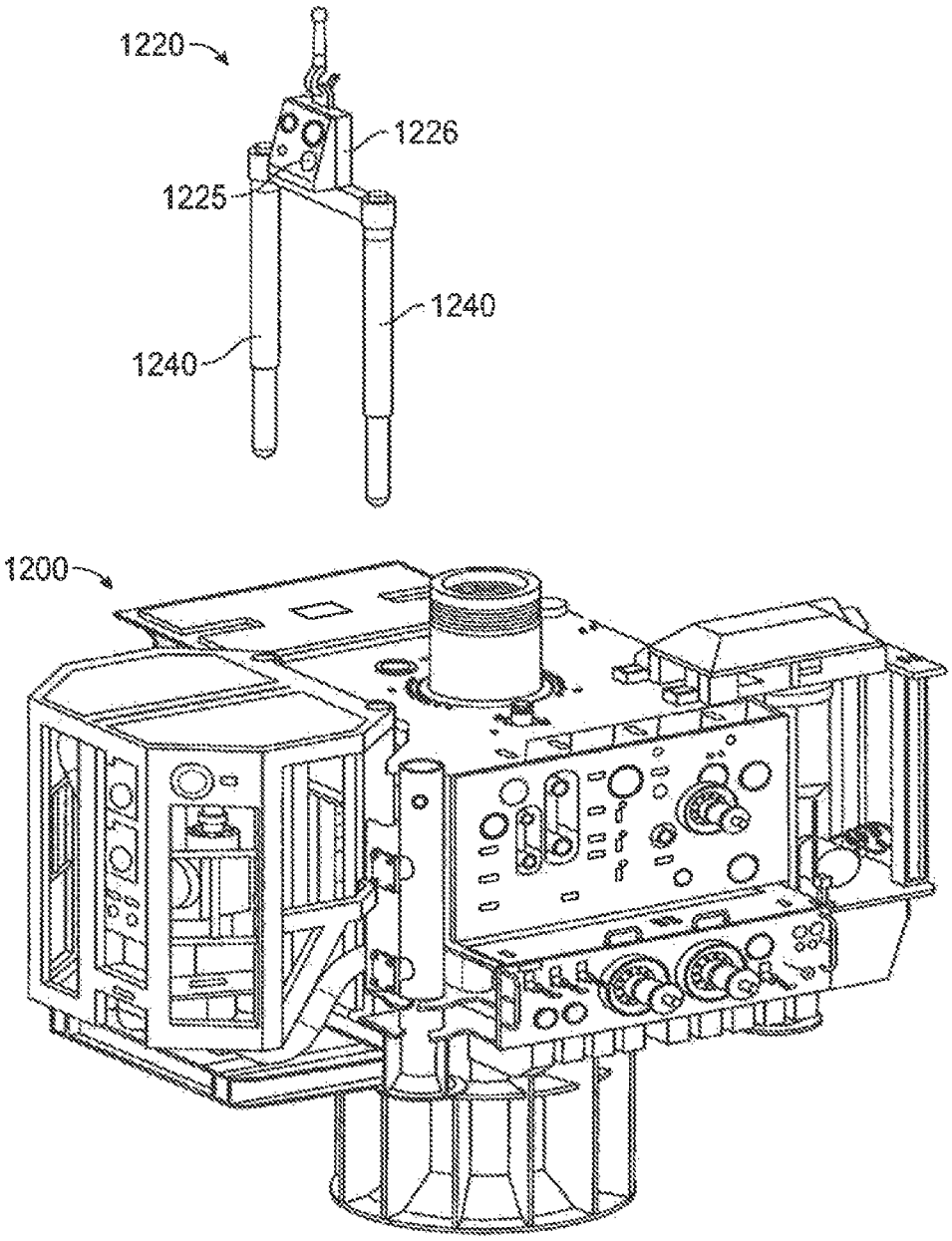

Based on the discussion above, and with reference to FIGS. 56-60, a complete running sequence for a module system and a retrievable landing system with a running tool is shown. A tree system 1100 is similar to the tree system 500, and a module system 1200 is similar to the module system 900. The module system 1200 with the retrievable running and landing system 1220 is lowed by crane. A ROV 1250 engages the module system 1200 near the tree system 1100, as shown in FIG. 56. The tree system 1100 includes a module interface 1105 including a fluid coupling hub 1106 and a support structure 1120, as described in detail elsewhere herein. Referring to FIG. 57, the ROV manipulates the module system 1200 into engagement with the support structure 1120 above the hub 1106. The module system 1200 is lowered in the support structure 1120 toward the hub 1106 as shown in FIG. 58. The ROV may couple to a ROV panel 1225 on a running tool 1226 via an arm 1251 for control purposes. Referring to FIG. 59, the module system 1200 decelerates as a result of the passive soft landing as previously described. The ROV arm 1251 may be coupled into another portion of the module system 1200 for hydraulic control, manipulation, and other purposes. The active hydraulic landing system is activated to lower the module system 1200 to a final position on the hub 1106, as previously described. The running tool 1226 is released as described herein and the running tool, landing system 1220, and cartridges 1240 are removed and raised to the surface.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed:

1. A wellhead system comprising:
a wellhead valve tree;
a hub connected into the wellhead valve tree by a fluid conduit extending laterally between the hub and the wellhead valve tree; and
an interface including the hub and a support structure;
wherein the interface support structure is configured to receive a fluid processing module such that the fluid processing module is in direct contact with both the interface support structure and the hub;
wherein the fluid conduit and the hub are configured to fluidly couple the fluid processing module to the wellhead valve tree across the interface;
wherein the interface support structure is configured to receive the fluid processing module and comprises a capture plate and a plurality of cylindrical receptacles each comprising an internal landing base located at an end of each of the cylindrical receptacles and configured to physically support a load from a landing system of the fluid processing module;
wherein the capture plate is configured to align the landing system of the fluid processing module with the cylindrical receptacles.

2. The wellhead system of claim 1, wherein the interface support structure comprises a load bearing plate that physically supports the capture plate and the plurality of cylindrical receptacles, wherein the plurality of cylindrical receptacles extend from the load bearing plate.

3. The system of claim 1, wherein:
the landing base of each of the cylindrical receptacles is located at a terminal end of each of the cylindrical receptacles; and
the landing system of the fluid processing module comprises a plurality of cartridges configured to physically engage the landing bases of the cylindrical receptacles when the fluid processing module is received by the interface support structure.

4. The system of claim 3, wherein each of the cartridges comprises a damper configured to provide a controlled deceleration of the fluid processing module in response to physical engagement between the cartridges and the landing bases of the cylindrical receptacles.

5. The system of claim 3, wherein each of the cylindrical receptacles comprises an axial slot configured to allow for the passage of the cartridge of the landing system through each of the cylindrical receptacles.

6. The system of claim 1, wherein the interface support structure comprises a support frame coupled to and supported by the wellhead valve tree, and wherein the hub is disposed on a floor of the support frame.

7. A wellhead system comprising:
a wellhead valve tree;
a hub connected into the wellhead valve tree by a fluid conduit extending laterally between the hub and the wellhead valve tree; and
an interface including the hub and a support structure;
wherein the interface support structure is configured to receive a fluid processing module and vertically align the fluid processing module over the hub such that the fluid processing module is in direct contact with both the interface support structure and the hub;
wherein the fluid conduit and the hub are configured to fluidly couple the fluid processing module to the wellhead valve tree across the interface;
wherein the interface support structure comprises a capture plate and a plurality of cylindrical receptacles;
wherein the capture plate is configured to align a landing system of the fluid processing module with the cylindrical receptacles such that each of the cylindrical receptacles is configured to support a load from the landing system.

8. The system of claim 7, wherein the capture plate comprises a plurality of capture wells aligned with the cylindrical receptacles.

9. The system of claim 7, wherein the interface support structure comprises a load bearing plate that physically supports the capture plate and the plurality of cylindrical receptacles, wherein the load bearing plate comprises a plurality of openings and wherein each of the openings defines an end of one of the cylindrical receptacles.

10. The system of claim 7, wherein:
each of the cylindrical receptacles comprises a landing base configured to physically support the landing system of the fluid processing module;
the landing base of each of the cylindrical receptacles is located at a terminal end of each of the cylindrical receptacles; and
the landing system of the fluid processing module comprises a plurality of cartridges configured to physically engage the landing bases of the plurality of cylindrical receptacles when the fluid processing module is received by the interface support structure.

11. The system of claim 10, wherein the cartridges are configured to provide an axial space separating the hub from the fluid processing module upon physical engagement between the cartridges and the landing bases of the cylindrical receptacles.

12. The system of claim 11, wherein each of the cartridges comprises a damper configured to provide a controlled deceleration of the fluid processing module prior to the fluid processing module contacting the hub.

13. The system of claim 7, wherein the cylindrical receptacles are disconnected from the hub.

14. A method of connecting a fluid processing module to a wellhead valve tree, the method comprising:

engaging the fluid processing module with an interface having a support structure and a hub connected into the wellhead valve tree by a fluid conduit extending laterally between the hub and the wellhead valve tree;

contacting a landing system of the fluid processing module with a capture plate of the interface support structure to align the landing system with a plurality of cylindrical receptacles of the interface support structure;

vertically aligning the fluid processing module over the hub with the interface support structure;

inserting the landing system of the fluid processing module into the cylindrical receptacles of the interface support structure;

engaging the fluid processing module with the hub to fluidly connect the fluid processing module with the wellhead valve tree;

whereby the fluid processing module is in direct contact with the interface support structure at the hub.

15. The method of claim 14, further comprising receiving a plurality of cartridges of the landing system in a plurality of capture wells formed in the capture plate of the interface support structure.

16. The method of claim 14, further comprising physically engaging a plurality of cartridges of the landing system with landing bases of the cylindrical receptacles.

17. The method of claim 16, further comprising using dampers of the cartridges to provide a controlled deceleration of the fluid processing module following physical engagement between the cartridges and the landing bases of the cylindrical receptacles.

18. The method of claim 17, further comprising contacting the hub with the fluid processing module following the controlled deceleration of the fluid processing module.

19. The method of claim 16, further comprising controllably bleeding hydraulic pressure from hydraulic cylinders of the cartridges to provide a controlled deceleration of the fluid processing module following physical engagement between the cartridges and the landing bases of the cylindrical receptacles.

* * * * *